US006526255B2

(12) United States Patent
Itoh et al.

(10) Patent No.: US 6,526,255 B2
(45) Date of Patent: Feb. 25, 2003

(54) COPYING APPARATUS HAVING PAPER INVERTING UNIT

(75) Inventors: Kiyoteru Itoh, Utsunomiya (JP); Masamitsu Inaba, Utsunomiya (JP); Toshiyasu Inoue, Tochigi (JP); Kazuo Watanabe, Utsunomiya (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/940,667

(22) Filed: Aug. 29, 2001

(65) Prior Publication Data

US 2002/0054777 A1 May 9, 2002

(30) Foreign Application Priority Data

Nov. 8, 2000 (JP) ..... 2000-340545

(51) Int. Cl.[7] ..... G03G 15/00

(52) U.S. Cl. ..... 399/401; 399/402; 399/405

(58) Field of Search ..... 399/107, 397, 399/401, 402, 405, 406; 271/3.03, 3.05, 3.08, 9.01, 65, 123, 301

(56) References Cited

U.S. PATENT DOCUMENTS 5,857,137 A * 1/1999 Sakata et al. ..... 399/402
6,188,866 B1 * 2/2001 Barnhart ..... 399/401
6,215,970 B1 * 4/2001 Yoshikawa et al. ..... 399/401 X

* cited by examiner

*Primary Examiner*—Hoan Tran
(74) *Attorney, Agent, or Firm*—Greenblum & Bernstein, P.L.C.

(57) ABSTRACT

In the copying apparatus, recording paper with an image on one side thereof formed in an image forming section is inserted into an auto document unit. In the auto document unit the recording paper is inverted upside down, while intervals of a plurality of sheets of recording paper are adjusted at predetermined positions, on an inverting path bent to form upper and lower stages.

23 Claims, 22 Drawing Sheets

COPYING APPARATUS HAVING PAPER INVERTING UNIT

BACKGROUND OF THE INVENTION

1. Field of the Invention

The present invention relates to a copying apparatus provided with an auto document unit that inverts upside down recording paper with an image formed on one side thereof to return to an image forming section that forms an image on the recording paper.

2. Description of the Related Art

In order to automatically form images on both sides of recording paper (herein referred to as "perform doubled-sided printing"), a conventional copying apparatus is provided with auto document unit 2201 that inverts upside down the recording paper with an image formed on one side thereof to return to an image forming section that forms an image on the recording paper.

Auto document unit 2201 has, as shown in FIG. 1, intermediate tray 2205 which is provided on passage 2204 between paper cassette 2202 and image forming section 2203, and which temporarily stores recording paper with an image formed on one side thereof.

That is, recording paper 2206 is taken out of paper cassette 2202 and conveyed to image forming section 2203. An image is formed on one side of recording paper 2206 and stored once in intermediate tray 2205. When the double-sided printing of a plurality of sheets is performed on the same original, a plurality of sheets of recording paper 2206 each with the same image formed on one side thereof are temporarily stacked and stored in intermediate tray 2205.

Next, in order to record an image on the other side of recording paper 2206, recording paper 2206 is taken out of intermediate tray 2205 and conveyed again to image forming section 2203. When the double-sided printing of a plurality of sheets is performed on the same original, recording paper 2206 is sequentially taken out of intermediate tray 2205, and the same image is formed on the other side of each paper. In this way the double-sided printing is achieved.

However, there arise a problem with the configuration of the conventional example, as follows.

Namely, in the configuration of the conventional example, a plurality of sheets of recording paper 2206 each with an image formed on one side thereof are stacked and stored temporarily in intermediate tray 2205, and then another image is formed on the other side of each sheet. Therefore, it requires a considerable amount of time for recording paper 2206 to undergo the double-sided printing and to finally be discharged outside the apparatus, resulting in a disadvantage in efficiency.

SUMMARY OF THE INVENTION

It is an object of the present invention to provide a copying apparatus capable of forming images efficiently on both sides of recording paper.

That is, in the copying apparatus of the present invention, recording paper with an image on one side thereof formed in an image forming section is inserted into an auto document unit, where the recording paper is inverted upside down while intervals between a plurality of sheets of recording paper are adjusted at predetermined positions on an inverting path which is bent to form two pile-shaped upper and lower stages.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

An embodiment of the present invention will be described specifically below with reference to accompanying drawings.

Figure 1:
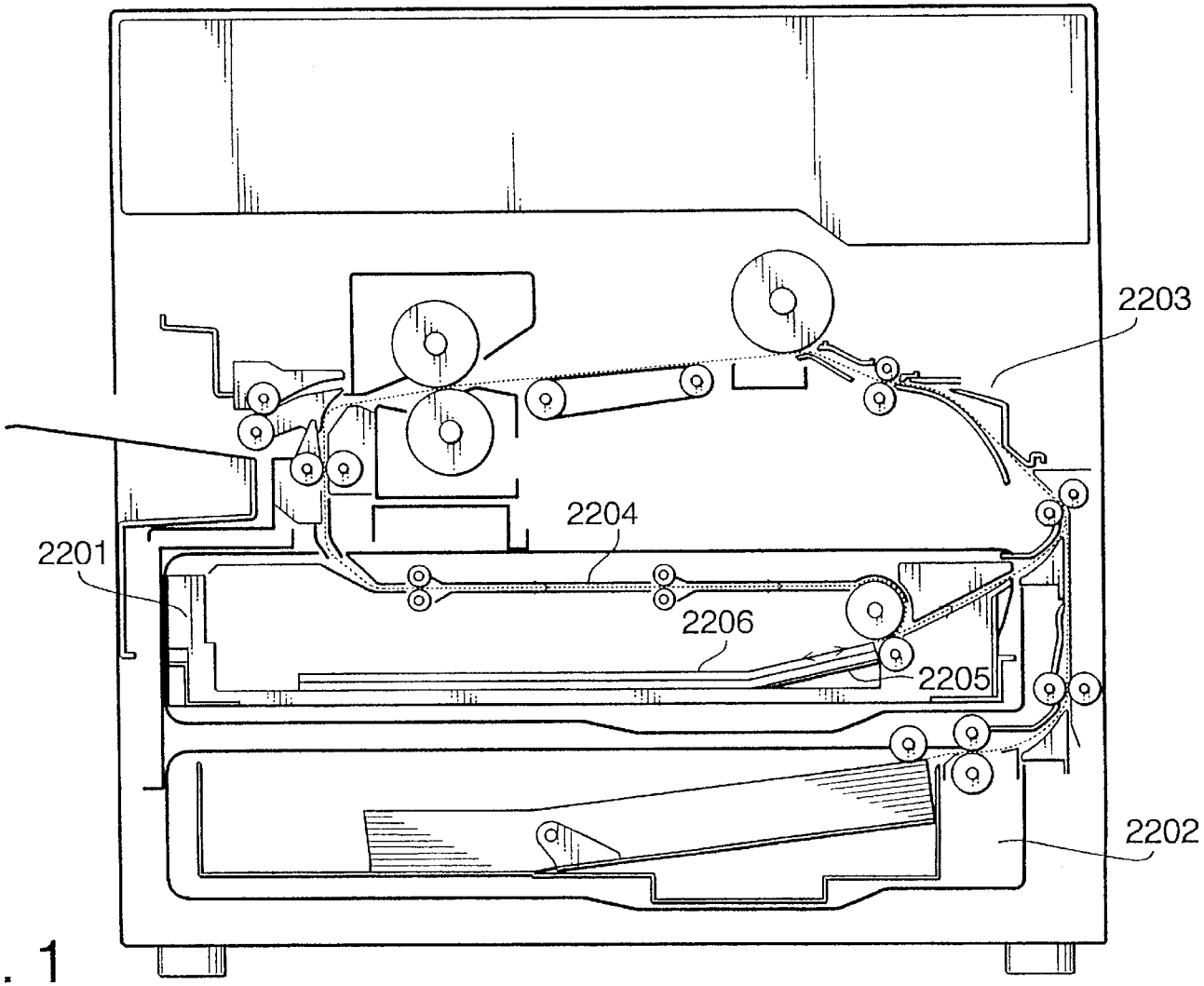
FIG. 1 PRIOR ART
FIG. 1 is a schematic sectional view showing an entire configuration of a conventional copying apparatus.
Figure 2:
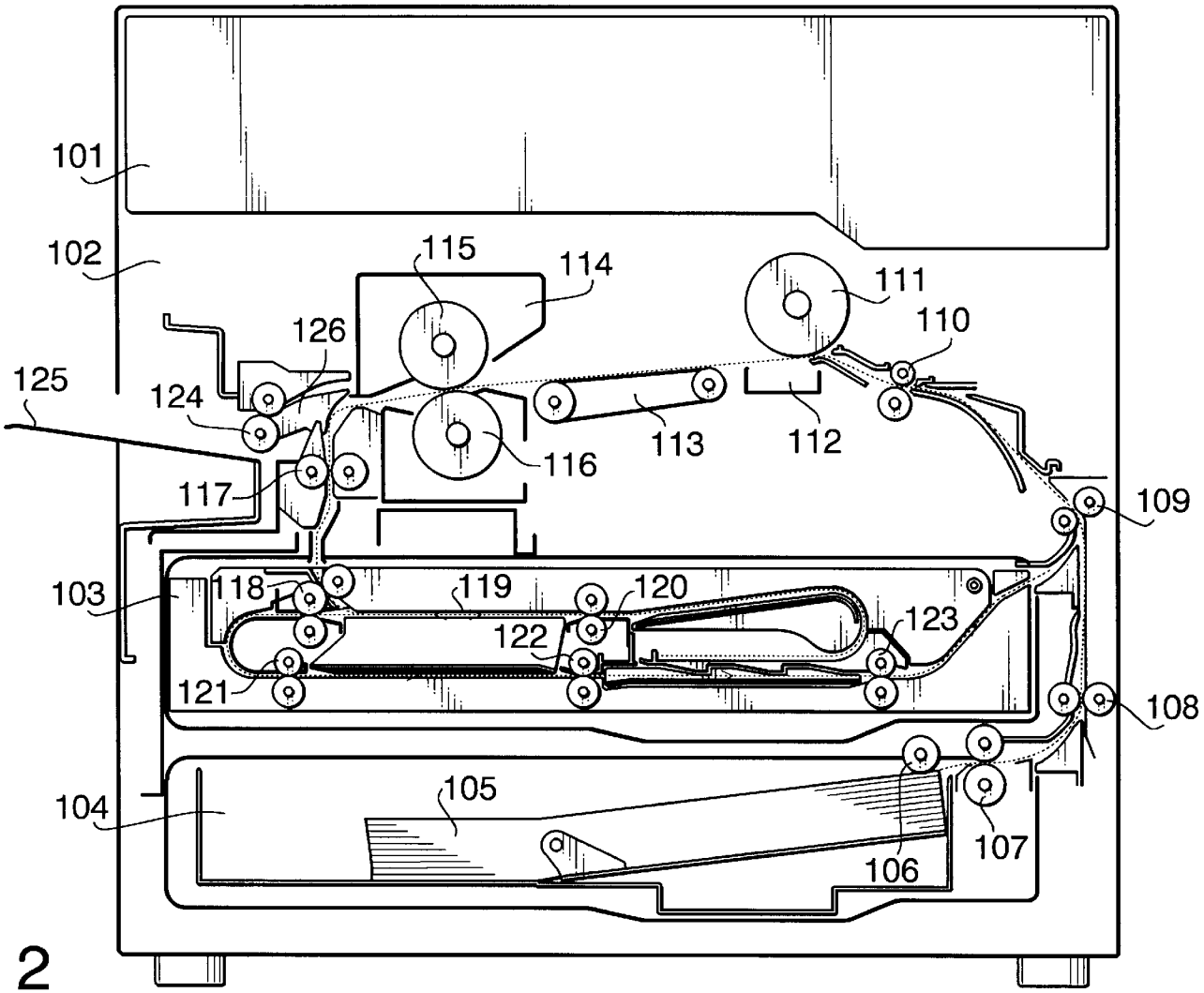
FIG. 2 is a schematic sectional view showing an entire configuration of a copying apparatus of one embodiment of the present invention.

FIG. 2 is a schematic sectional view showing an entire configuration of copying apparatus 100 according to this embodiment. In the following description, "right side of copying apparatus 100" and "left side of copying apparatus 100" indicate respectively the right side and left side as viewed in FIG. 2.

In FIG. 2, copying apparatus 100 is comprised of scanning section 101 that scans an original, image forming section 102 that forms an image of the original scanned by scanning section 101, auto document unit 103 that inverts recording paper when images are formed on both sides of the recording paper, and paper cassette 104 that feeds the recording paper to image forming section 102.

In copying apparatus 100 configured as described above, when the double-sided printing is performed on recording paper, scanning section 101 first scans an image of an original, and stores scanned image data in an internal memory.

Meanwhile, a sheet of recording paper placed on the uppermost of recording paper bunch 105 is taken out of paper cassette 104 by pick-up roller 106. The recording paper taken out of paper cassette 104 is conveyed sequentially by paper roller 107 and intermediate roller 108, and is fed into image forming section 102.

In image forming section 102, the recording paper is conveyed by intermediate roller 109 to register roller 110. Register roller 110 feeds the recording paper between photoconductor 111 and transferring section 112. On photoconductor 111 is formed an image corresponding to image data stored in the memory. Transferring section 112 transfers the image formed on photoconductor 111 on one side of the recording paper. At this point, register roller 110 adjusts positions of the image formed on photoconductor 111 and of a front end of the recording paper.

The recording paper with the image transferred on one side thereof is conveyed to fixing unit 114 by conveying belt 113. In fixing unit 114, fixing roller applies heat to a recording surface of the recording paper, and pressing roller 116 presses the recording paper against fixing roller 115. The image is thereby fixed to the recording paper. The recording paper with the image fixed thereto is fed into auto document unit 103 by discharging roller 117.

In auto document unit 103, the recording paper is taken in inverting path 119 formed inside auto document unit 103 by storing roller 118. The taken-in recording paper is once conveyed to the right side of copying apparatus 100. When the rear end of the recording paper is taken in, the recording paper is next fed to the left side of copying apparatus 100. At this point, the recording paper is inverted. The recording paper fed to the left side by inverting roller 120 is further fed to the left side of copying apparatus 100 by storing roller 118. The recording paper fed to the left side by storing roller 118 changes the direction of its feeding to turn along inverting path 119, and is conveyed to the right side of copying apparatus 100. By first discharging roller 121, second discharging roller 122 and third discharging roller 123, the recording paper is further conveyed to the right side, and is conveyed again to image forming section 102.

In image forming section 102, an image is transferred and fixed to the other side of the recording paper inverted in auto document unit 103. The recording paper with images formed on both sides is discharged to discharging tray 125 by discharging roller 124. In addition, discharging switch 126 switches whether the recording paper is fed to auto document unit 103 or is discharged to discharging tray 125.

Figure 3:
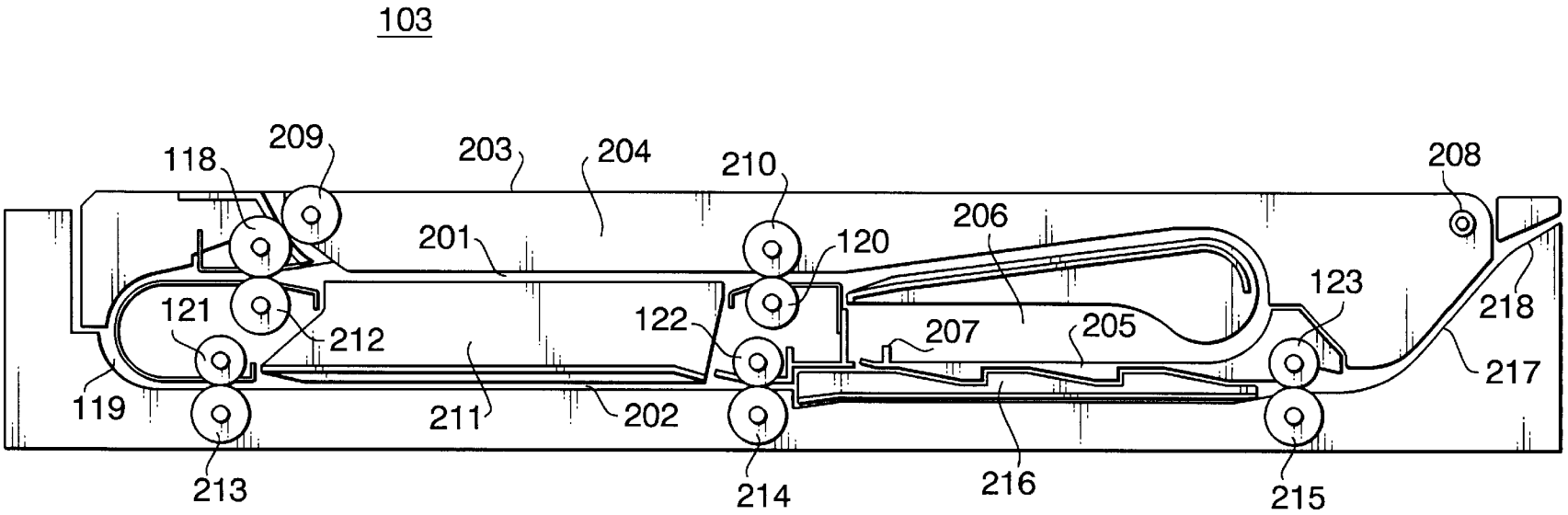
FIG. 3 is a sectional side view showing a specific configuration of an auto document unit in the copying apparatus according to the above embodiment.

FIG. 3 is a sectional side view showing a specific configuration of above-mentioned auto document unit 103. Auto document unit 103 is configured to enable itself to be drawn out of copying apparatus 100, in order to remove recording paper when a paper jam occurs in the unit. FIG. 3 shows auto document unit 103 being drawn out of copying apparatus 100.

In auto document unit 103 is formed inverting path 119 which inverts the recording paper with an image formed on one side thereof supplied from image forming section 102 as described above to discharge again to image forming section 102, and which is formed wholly inside the unit 103. In auto document unit 103, a predetermined number of sheets of recording paper are circulated on inverting path 119 corresponding to the size of the recording paper and are inverted and fed to image forming section 102 sequentially.

By thus circulating a predetermined number of sheets of recording paper on inverting path 119, when the double-sided printing of a plurality of sheets is performed on the same original, it is possible to greatly shorten the time during which a first recording paper sheet with images formed on both sides thereof is discharged outside the apparatus. It is there by possible to form images on both sides of the recording paper efficiently.

In addition, as shown in FIG. 3, inverting path 119 is bent to form two pile-shaped upper and lower stages. In the following description, an upper portion of inverting path 119 is referred to as upper path 201, and a lower portion of inverting path 119 is referred to as lower path 202.

Upper cover 203 cover supper path 201, and is composed of first cover 204 forming an upper surface of upper path 201, and second cover 205 covers a part of the right side of lower path 202. On the right side of first cover 204 above second cover 205 is provided storing section 206 that stores one end of the recording paper when the size of the recording paper to invert is large.

Storing section 206 has the form for turning the recording paper to feed to the left on the right side of auto document unit 103. One end of the recording paper fed to storing section 206 by inverting roller 120 is conveyed to the left side while changing the direction of paper feeding to turn along the form of storing section 206. In an end portion on the left side of storing section 206 is provided stopper 207 that stops the conveyance of the recording paper.

Storing section 206 forms a part of a lower surface of the right side of upper path 201. Second cover 205 forms a part of an upper surface of the right side of lower path 202, and has the form of waves corresponding to the form of an incline correcting guide described later upper cover 203 has the form that enables the left-side portion thereof to be opened and closed with respect to the housing of auto document unit 103 with axis 208, as a support, provided on the right side of auto document unit 103. When upper cover 203 is closed, following rollers 209 and 210, which move according to storing roller 118 and inverting roller 120, are disposed on first cover 204 at positions corresponding to the rollers 118 and 120, respectively.

Below the left side of upper cover 203 is provided lower cover 211. Lower cover 211 is attached to the housing of auto document unit 103, and the right-hand portion thereof is movable vertically. Lower cover 211 forms on its upper surface a part of the lower surface of the left side of upper path 201, while forming on its lower surface a part of an upper surface of the left side of the lower path 202.

On the housing of auto document unit 103 is disposed roller 212, to the left side of lower cover 211, at a position corresponding to storing roller 118. Roller 212 rotates according to storing roller 118. The lower surface of lower path 202 is formed by the housing of auto document unit 103. Rollers 213 to 215 are provided on the housing of auto document unit 103 respectively at positions corresponding to first discharging rollers 121 to third discharging roller 123. Rollers 213 to 215 rotate respectively according to discharging rollers 213 to 215. Each of rollers 213 to 215 is applied a force by a spring (not shown in the figure) to be suitable for feeding the recording paper.

Between rollers 214 and 215 are provided incline correcting guides 216 for correcting an incline of recording paper. Incline correcting guides 216 slide on the housing of auto document unit 103 in the direction of respective side surfaces.

Lower path 202 is formed to be sloped upwardly after roller 215 in the vicinity of a discharging opening for recording paper. Hereinafter, the slope portion is referred to as first slope portion 217. Second slope portion 218 is formed to be continued to first slope portion 217. A slope angle of second slope portion 218 is a little smaller than that of first slope portion 217.

Since first cover 204 of upper cover 203 thus forms the upper surface of upper path 202, first cover 204 immediately functions as the upper surface of upper path 201, whereby it is possible to miniaturize a configuration of the apparatus.

Further, since second cover 205 of upper cover 203 forms a part of the upper surface of lower path 202, second cover 205 immediately functions as the upper surface of lower path 202, whereby it is possible to miniaturize a configuration of the apparatus.

Furthermore, since lower cover 211 forms on its upper surface a part of the lower surface of upper path 201, while forming on its lower surface a part of the upper surface of lower path 202, lower cover 211 immediately functions as respective parts of upper path 201 and lower path 202 with the same material, whereby it is possible to miniaturize a configuration of the apparatus.

There occurs a case that since recording paper inserted into auto document unit 103 is long, the paper is not accommodated in upper path 201 before being guided from upper path 201 to lower path 202 of inverting path 119. Even in this case, storing section 206 that stores the recording paper by bending the paper is provided between first cover 204 and second cover 205 of upper cover 203, whereby a space between first cover 204 and second 205 is used effectively. Accordingly, it is possible to store also long recording paper on upper path 201 before guiding it to lower path 202, without enlarging auto document unit 103.

Further, since storing section 206 is provided between first cover 204 and second cover 205 of upper cover 203 to be integrated into upper cover 203, the recording paper stored in storing section 206 can be removed easily by opening upper cover 203.

Figure 4:
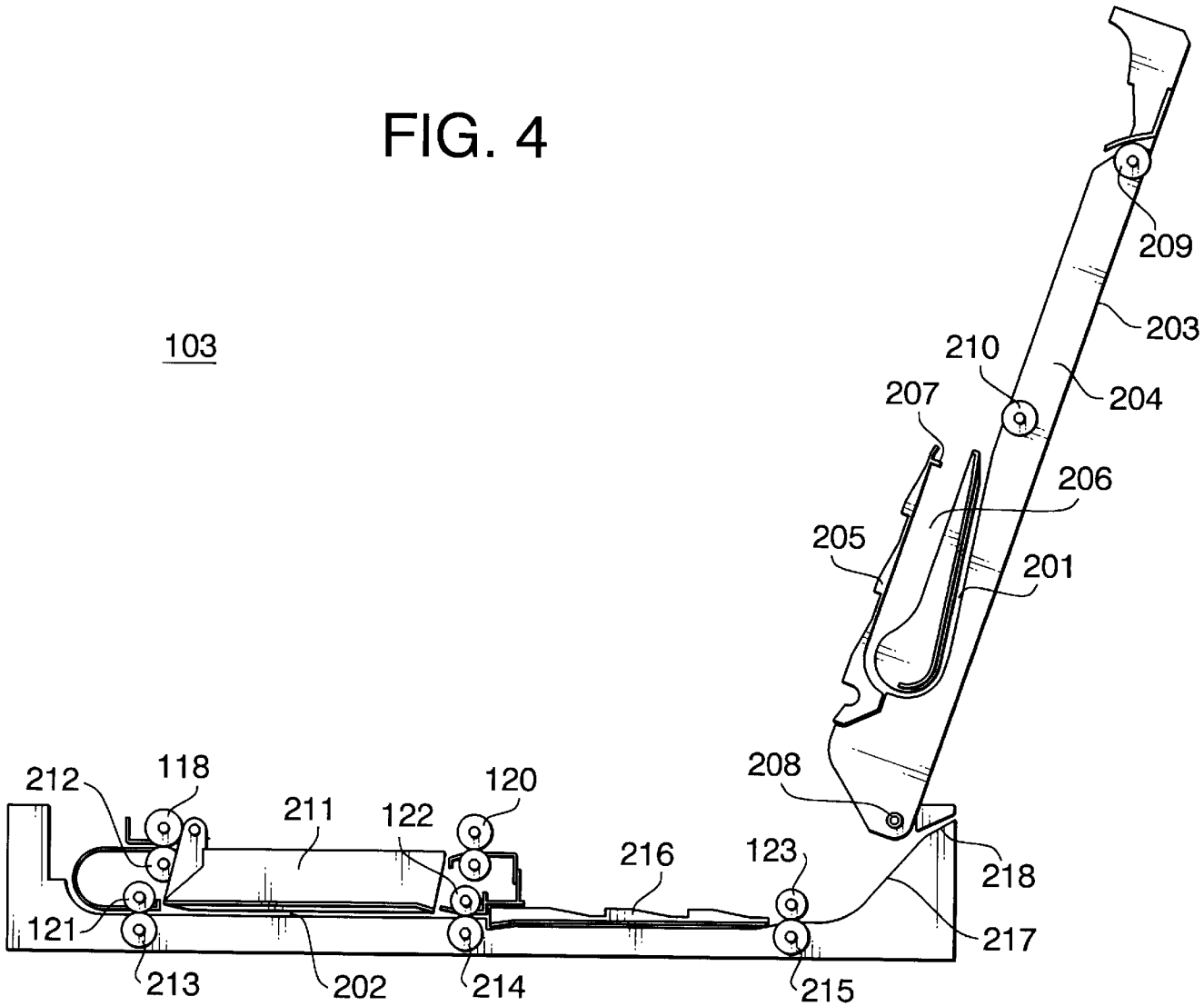
FIG. 4 is a sectional side view showing the auto document unit with an upper cover thereof opened in the copying apparatus according to the above embodiment.
Figure 5:
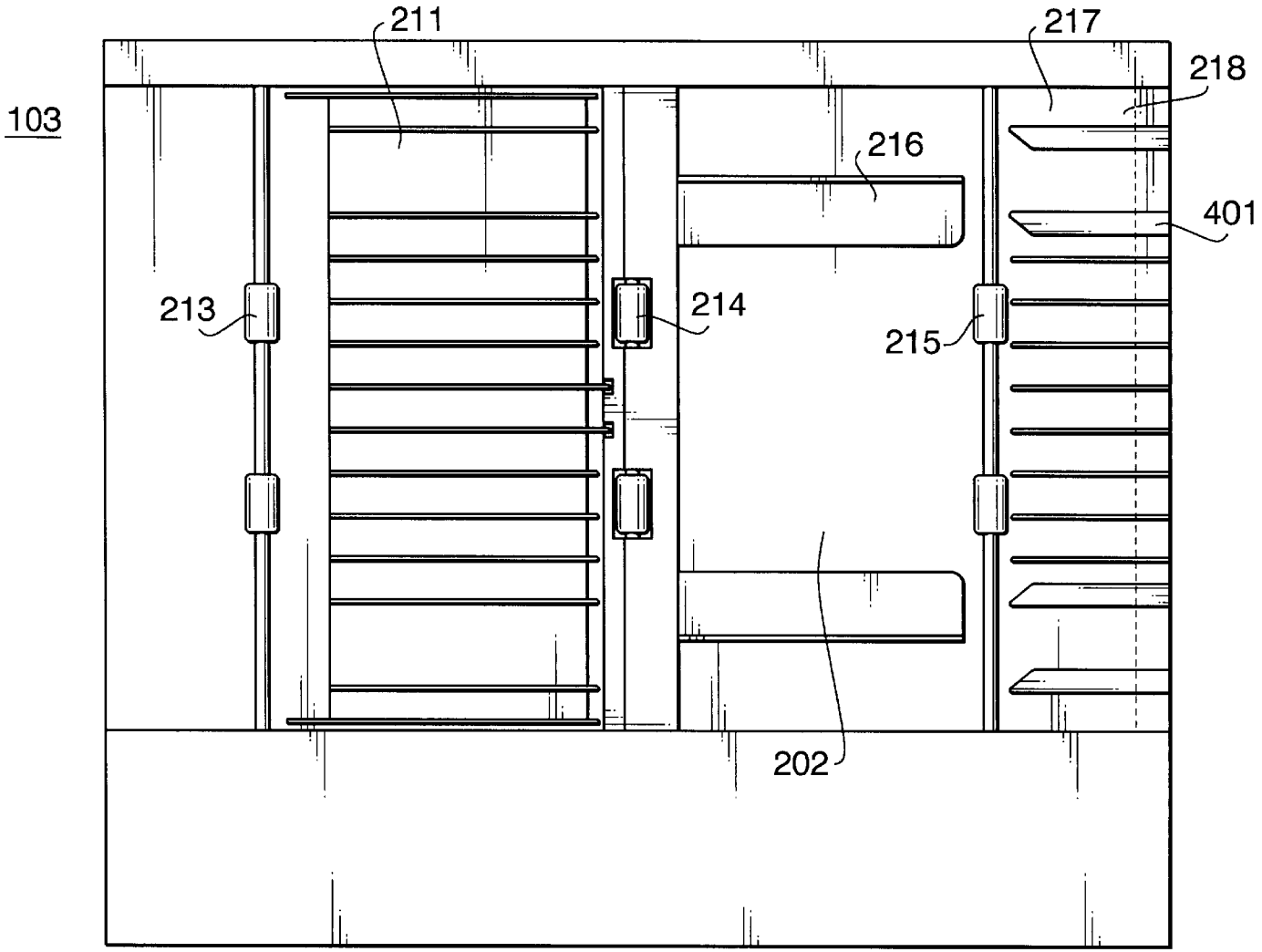
FIG. 5 is an upper plan view showing the auto document unit with the upper cover opened in the copying apparatus according to the above embodiment.

FIG. 4 shows a sectional side view of auto document unit 103 with upper cover 203 opened. FIG. 5 shows an upper plan view of auto document unit 103 with upper cover 203 opened. In addition, FIG. 5 shows only rollers 213 to 215 disposed on the housing of auto document unit 103, lower cover 211 and incline correcting guides 216.

As shown in FIGS. 4 and 5, opening upper cover 203 exposes almost the whole area of upper path 201 and a part of the right side of lower path 202. In auto document unit 103 of copying apparatus 100 recording paper is circulated on inverting path 119 bent to form two pile-shaped upper and lower stages. Therefore, when a paper jam occurs inside the unit 103, it is necessary to remove the recording paper from inverting path 119, thereby making the user operation complicated. However, as described above, opening upper cover 203 exposes almost the whole area of upper path 201 and a part of the right side of lower path 202 at one time. Thus, even in the configuration where recording paper is inverted by inverting path 119 bent to form two pile-shaped upper and lower stages, it is possible to decrease the number of times upper cover 203 is opened. It is thereby possible to greatly reduce an operation load on a user when a paper jam occurs.

Further since storing section 206 forms a part of the lower surface of upper path 201 of inverting path 119, first cover 204 and storing section 206 forms a part of upper path 201. Accordingly, when a paper jam occurs, upper cover 203 can be opened with the recording paper held in upper cover 203, whereby the operation for removing the recording paper is made easy.

Figure 6:
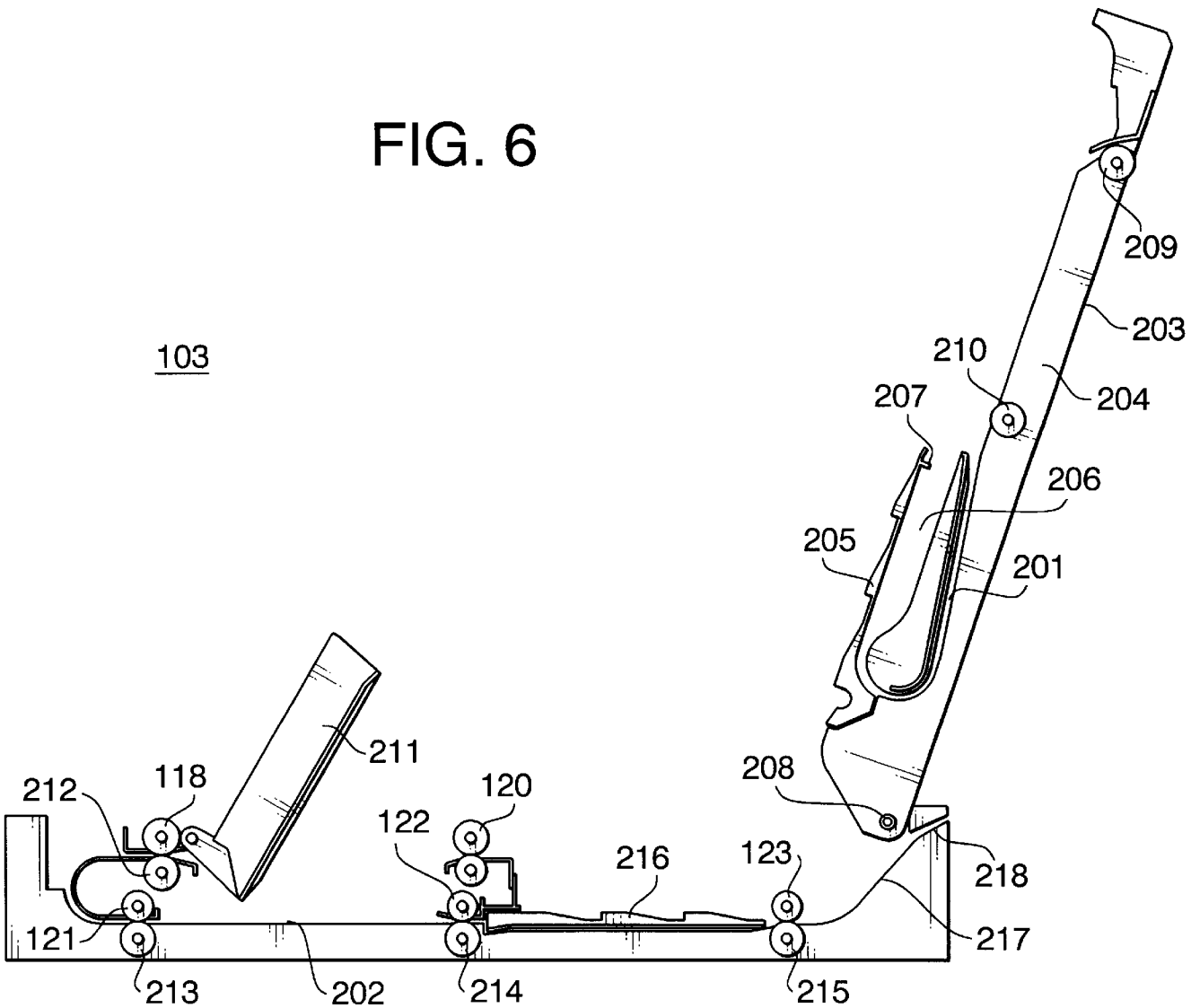
FIG. 6 is a sectional side view showing the auto document unit with the upper cover opened and further with a lower cover thereof opened in the copying apparatus according to the above embodiment.
Figure 7:
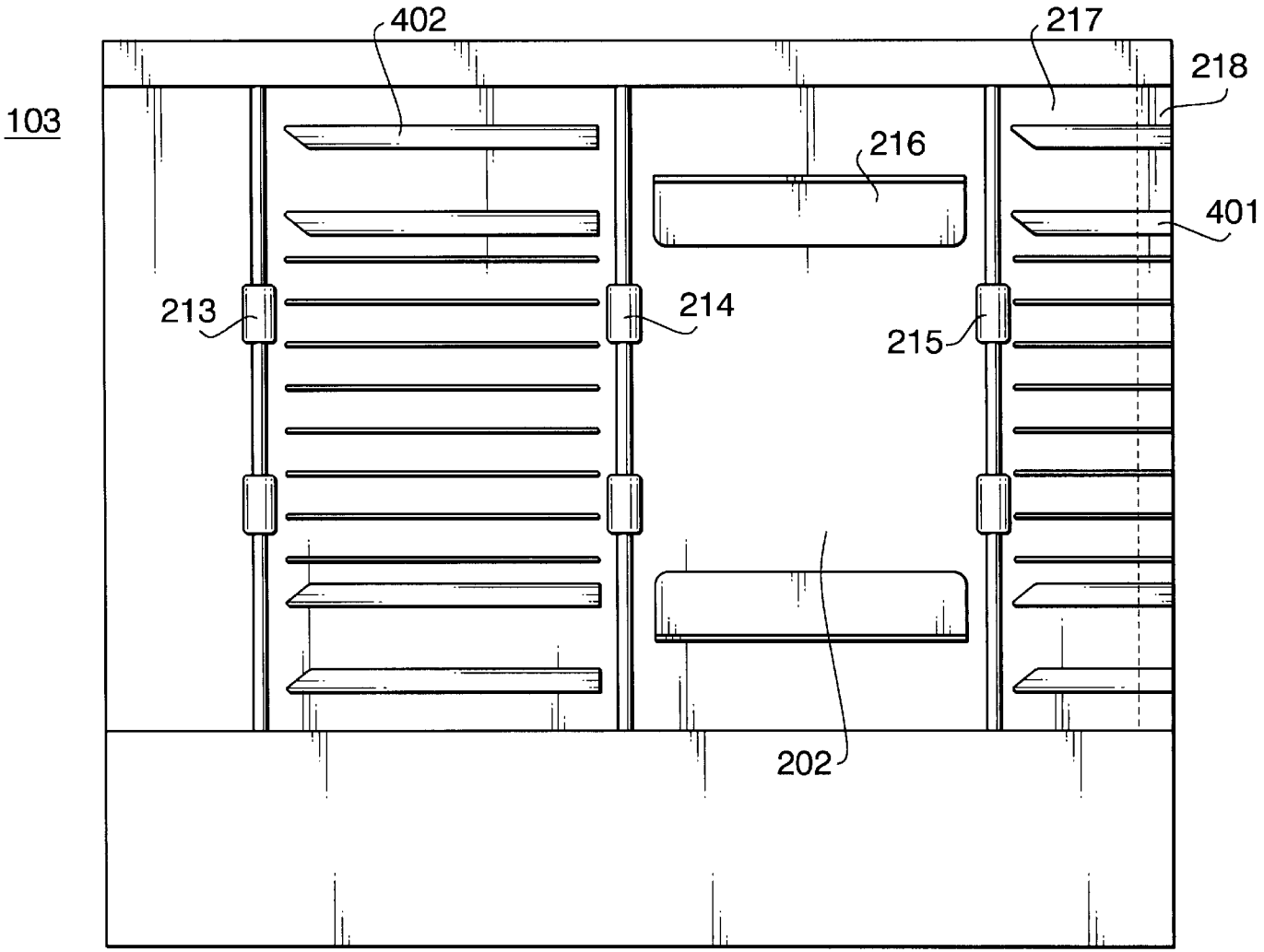
FIG. 7 is an upper plan view showing the auto document unit with the upper cover opened and further with the lower cover opened in the copying apparatus according to the above embodiment.

FIG. 6 shows an enlarged sectional view of auto document unit 103 with upper cover 203 opened and further with lower cover 211 opened. FIG. 7 shows an upper plan view of auto document unit 103 with upper cover 203 and lower cover 211 both opened. In addition, in FIG. 7, similarly to FIG. 5, rollers 213 to 215 disposed on the housing of auto document unit 103 and incline correcting guides 216 are only shown, and lower cover 211 is omitted.

As shown in FIGS. 6 and 7, opening upper cover 203 and further opening lower cover 211 exposes a part of the left side of lower path 202 in addition to almost the whole area of upper path 201 and a part of the right side of lower path 202. Almost the whole area of lower path 202 is thus opened, and it is thereby possible to greatly reduce an operation load on a user when a paper jam occurs, even in the configuration where recording paper is inverted by inverting path 119 bent to form two pile-shaped upper and lower stages.

As shown in FIG. 6, lower cover 211 is provided at a position that enables the cover 211 to be opened only when upper cover 203 is opened, and is attached to have a maximum opening angle enabling the cover 211 to fall down by its weight when the cover 211 is opened to an angle within the maximum opening angle. FIG. 6 shows lower cover 211 opened at the maximum opening angle.

In this way lower cover 211 that should be closed first falls down by its weight when a user releases it. Accordingly, it is possible to assuredly avoid such a wrong operation that upper cover 203 is closed first. Further, it is possible to assuredly avoid such a situation that upper cover 203 or lower cover 211 is broken because upper cover 203 bangs against lower cover 211 that is being opened when upper cover 203 is closed first.

As shown in FIGS. 5 and 7, feeding ribs 401 and 402 are formed, along the direction of feeding of recording paper, respectively before and after incline correcting guides 216 on the housing of auto document unit 103 forming the lower surface of lower path 202.

Feeding ribs 401 and 402 are provided with a height for spacing the recording paper apart from the lower surface of lower path 202. A contact surface between the recording paper and inverting path 119 is thereby reduced, whereby the recording-paper feeding characteristic is improved.

Feeding ribs 401 and 402 are vertical in their center portion to the lower surface of lower path 202. The ribs are formed to have a gentler slope on their inner side as being spaced apart from the center portion (upwardly or downwardly in FIGS. 5 and 7).

Feeding ribs 403 with the same form as feeding ribs 402 are provided each at a position opposite to corresponding feeding rib 402, i.e., at a position opposite to the lower surface of lower cover 211. Feeding ribs 404 with the same form as feeding ribs 401 are further provided each at a position opposite to corresponding feeding rib 401, i.e., at slope portions opposite to first slope portion 217 and second slope portion 218 of upper cover with upper cover 203 closed.

Figure 8A:
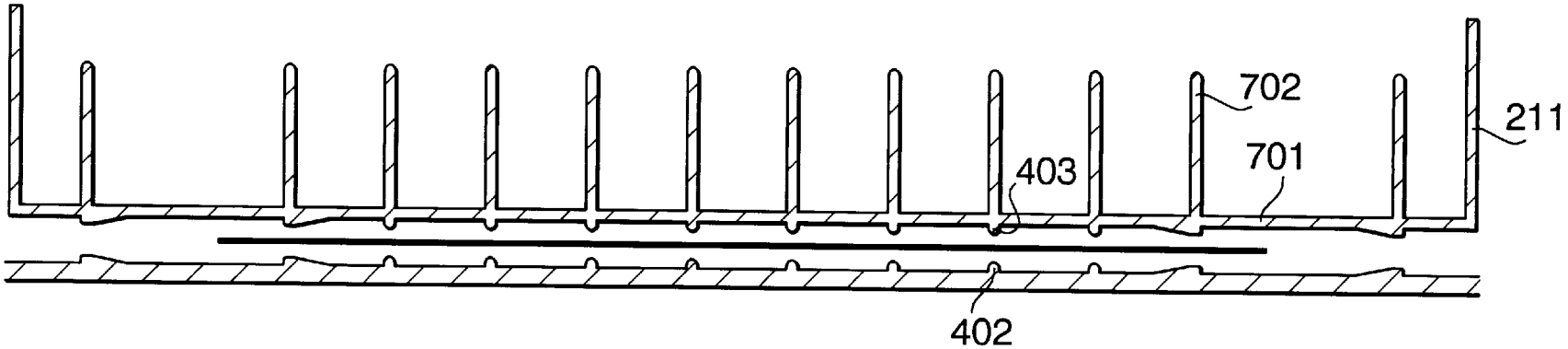
FIG. 8A is an enlarged view showing upper and lower feeding ribs opposite to each other provided in the auto document unit in the copying apparatus according to the above embodiment.
Figure 8B:
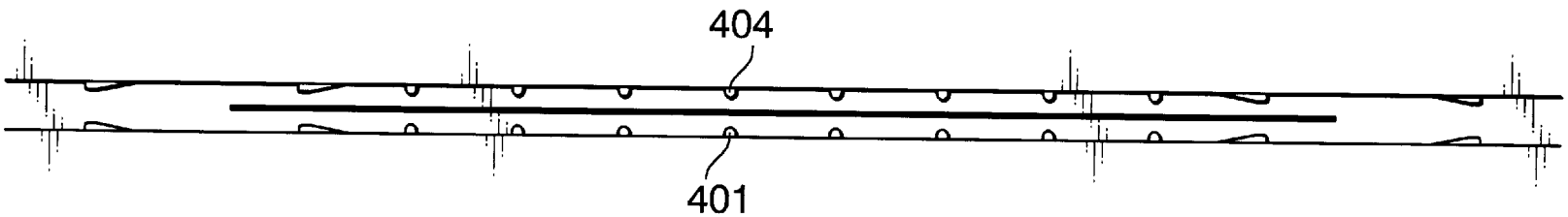
FIG. 8B is an enlarged view showing upper and lower feeding ribs opposite to each other provided in the auto document unit in the copying apparatus according to the above embodiment.

FIG. 8 shows enlarged views of feeding ribs 401 and 402 being opposite to feeding ribs 403 and 404 provided on the lower surface of lower cover 211 and so on. FIG. 8A shows an enlarged view of feeding ribs 402 and feeding ribs 403 provided on the lower surface of lower cover 211, and FIG. 8B shows an enlarged view of feeding ribs 401 and feeding ribs 404 provided at slope portions opposite to first slope portion 217 and second slope portion 218. FIG. 8 shows a condition that recording paper is conveyed between upper and lower feeding ribs. As shown in FIG. 8, each rib is disposed at a position opposite to a corresponding rib.

Feeding ribs 401 to 404 are thus provided in the above-mentioned form before and after incline correcting guides 216. Therefore, even when the side end portion of recording paper makes contact with feeding ribs 401 to 404, the side end portion climbs over feeding ribs 401 to 404, while climbing the gentle slows of feeding ribs 401 and 404. Accordingly, the side end portion of recording paper is prevented from being caught in a cavity between the feeding ribs. It is thereby possible to improve the recording-paper feeding characteristic and to correct the incline of recording paper properly.

As shown in FIG. 8A, lower cover 211 has plane 701 formed as its lower surface on which feeding ribs 403 are provided. Meanwhile, lower cover 211 has an upper surface formed by frond ends of a plurality of ribs 702 with the same form formed on plane 701.

Lower cover 211 has a plurality of ribs 702 with the same form to form its upper surface, while having on its lower surface feeding ribs 403 formed to have a gentler slope on their inner side as being spaced apart from the center portion. It is thereby possible to reduce a contact surface between the upper surface of the cover 211 and the recording paper, whereby the recording-paper feeding characteristic is improved. Meanwhile, on the lower surface of the cover 211, end portions of the recording paper climb up the gentle slopes of feeding ribs 403 and climb over the ribs 403. The side end portion of recording paper is thus prevented from being caught in a cavity between the feeding ribs. Accordingly, it is possible to while maintaining the recording-paper feeding characteristic, avoid such a situation that the incline of the recording paper cannot be corrected properly due to the feeding rib.

The upper surface of lower cover 211 does not need to form a plane because the recording paper is only conveyed. Meanwhile, the lower surface of lower cover 211 needs to have face-to-face contact with the recording paper in order to prevent the recording paper moving to undergo the incline correction from moving upwardly.

Lower cover 211 thus has the lower surface formed by plane 701 and the upper surface formed by fronds ends of ribs 702 provided on plane 701. In this way the lower surface of lower cover 211 is brought into face-to-face contact with the recording paper, whereby it is possible to prevent the recording paper from moving upwardly and to correct the incline of the recording paper properly.

Thus, in lower cover 211, the lower surface has the form of a plane, while the upper surface does not have the form of a plane. Accordingly, it is possible to reduce the weight of lower cover 211 while holding the strength of lower cover 211. It is thereby possible to use lower cover 211 as a conveying path of recording paper without impairing its function as a cover and to reduce the load for opening or closing.

In auto document unit 103, a plurality of rollers for feeding recording paper are composed of a plurality of pairs of a driving roller and a roller (hereinafter referred to as "following roller") that rotating according to the rotation of the driving roller. These following rollers are pressed against corresponding driving rollers by spring pressure, and thereby hold a constant position relationship with the driving rollers to convey the recording paper. However, when either roller of the pair is attached to upper cover 203, the driving roller and following roller are spaced apart from each other. Therefore, there is a case that when upper cover 203 is closed, the spring of the following roller does not press the following roller against the driving roller, but works in the direction that the following roller is spaced apart from the driving roller.

In this case, the position relationship between the driving roller and following roller differs from the expected one. As a result, the feeding force of rollers is not applied to the recording paper adequately, thereby disabling the recording paper to be fed.

Hence, in auto document unit 103, pressing means for being pressed from an upper portion to press upper cover 203 downwardly is provided on the upper surface of upper cover 203 to cope with the above-mentioned problem.

Figure 9:
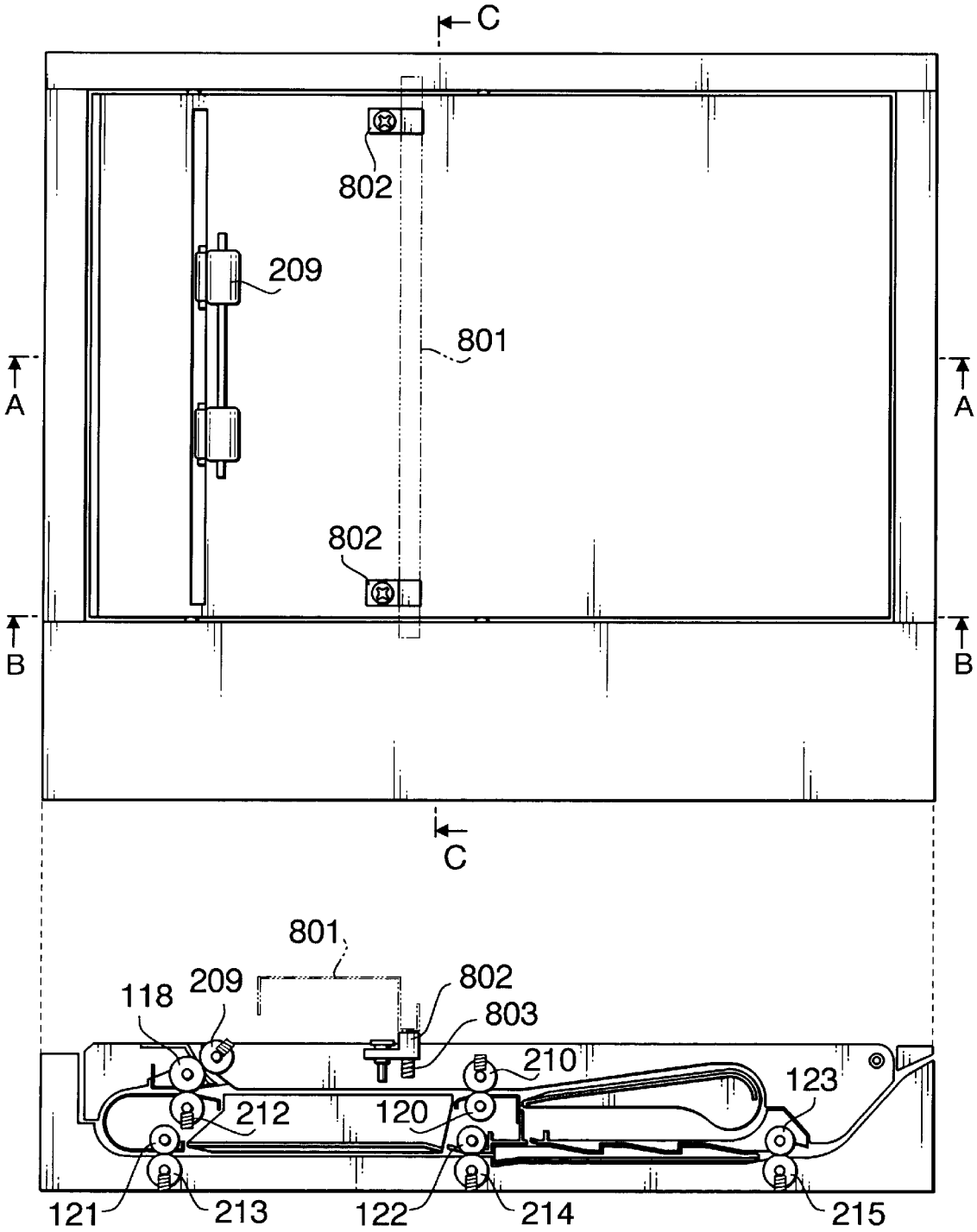
FIG. 9 illustrates an upper plan view and a sectional side view showing a relationship between rollers and springs disposed in the auto document unit, and pressing means provided on an upper surface of the upper cover in the copying apparatus according to the above embodiment

FIG. 9 illustrates an upper plan view and a sectional side view showing a relationship between rollers and springs disposed in auto document unit 103 and pressing means provided on the upper surface of upper cover 203. FIG. 9 shows the sectional side view taken along the solid line A—A of the upper plan view.

As shown in the sectional side view in FIG. 9, springs are provided that press following rollers 209, 210 and 212 to 215 provided in auto document unit 103 against opposite driving rollers 118, 120 and 121 to 123, respectively. Above upper cover 203 is provided contact member 801 attached to the housing of copying apparatus 100. Contact member 801 is constructed to be slightly longer than inverting path 119 in the direction vertical to the recording-paper feeding direction (see FIG. 12B). Contact member 801 is in the vicinity of its end portion in contact with pressing means 802 provided on upper cover 203.

Pressing means 802 is at its one end screwed on upper cover 203 to enable its slight vertical movement. Under the other end of pressing means 802 is disposed spring 803. Spring 803 applies a spring pressure to the means 802 so that the other end of the means 802 projects from the upper surface of upper cover 203.

Figure 12A:
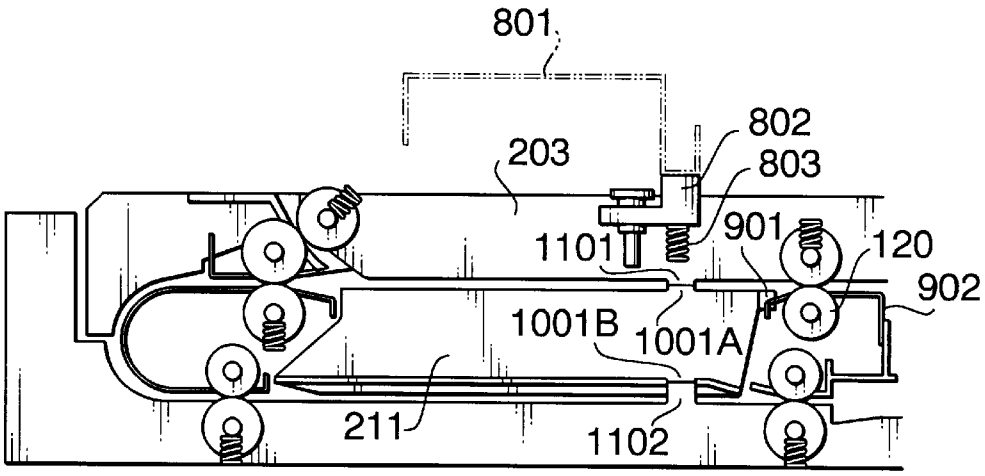
FIG. 12A is a sectional side view showing a relationship between projecting portions provided on the lower cover and other projecting portions provided on the upper cover and a housing of the auto document unit in the copying apparatus according to the above embodiment.
Figure 12B:
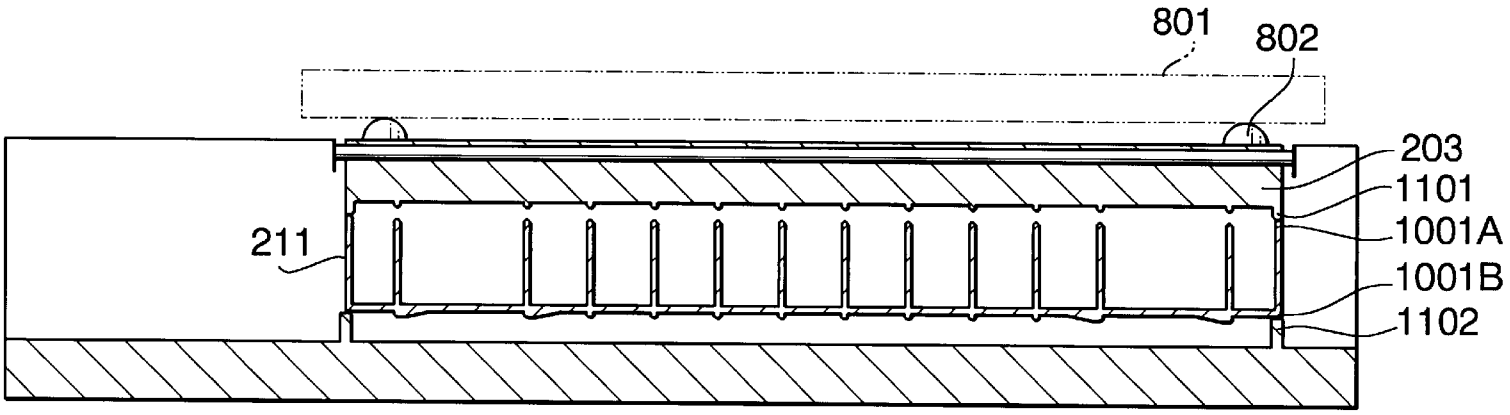
FIG. 12B is another sectional side view showing a relationship between projecting portions provided on the lower cover and other projecting portions provided on the upper cover and housing of the auto document unit in the copying apparatus according to the above embodiment.

An upper portion of the other end of pressing means is shaped in the form of an arc of a semicircle, and contact member 801 is in contact with the means 802 in the periphery of the arc (see FIG. 12B). In addition, the force that pressing means 802 applies to upper cover 203 to press downwardly is larger than the sum of the force of spring pressures from following rollers for pressing upwardly upper cover 203 and the force needed to correct the bend of lower cover 211.

On the upper surface of upper cover 203 is thus provided pressing means 802 for pressing downwardly upper cover 203 due to being pressed from an upper portion. Then, the force that pressing means 802 applies to upper cover 203 to press downwardly is set to be larger than the force of spring pressures of following rollers for pressing upwardly upper cover 203. In this way the spring pressures of following rollers work in the direction for pressing following rollers against driving rollers. It is thereby possible to apply a proper feeding force to recording paper even when following rollers are attached to upper cover 203.

When upper cover 203 is pressed downwardly to press the following rollers against the driving rollers, there is a risk that a center area of lower cover 211 may bend downwardly due to this pressure force and a heat of the recording paper having undergone fixing pressure, etc. In this case there arises a problem that the recording paper is not conveyed properly.

Auto document unit 103 copes with the above-mentioned problem by being provided with holding means for preventing the center area of lower cover 211 from bending downwardly and with bend preventing means for nipping side end portions of lower cover 211 vertically to prevent lower cover 211 from bending.

Figure 10:
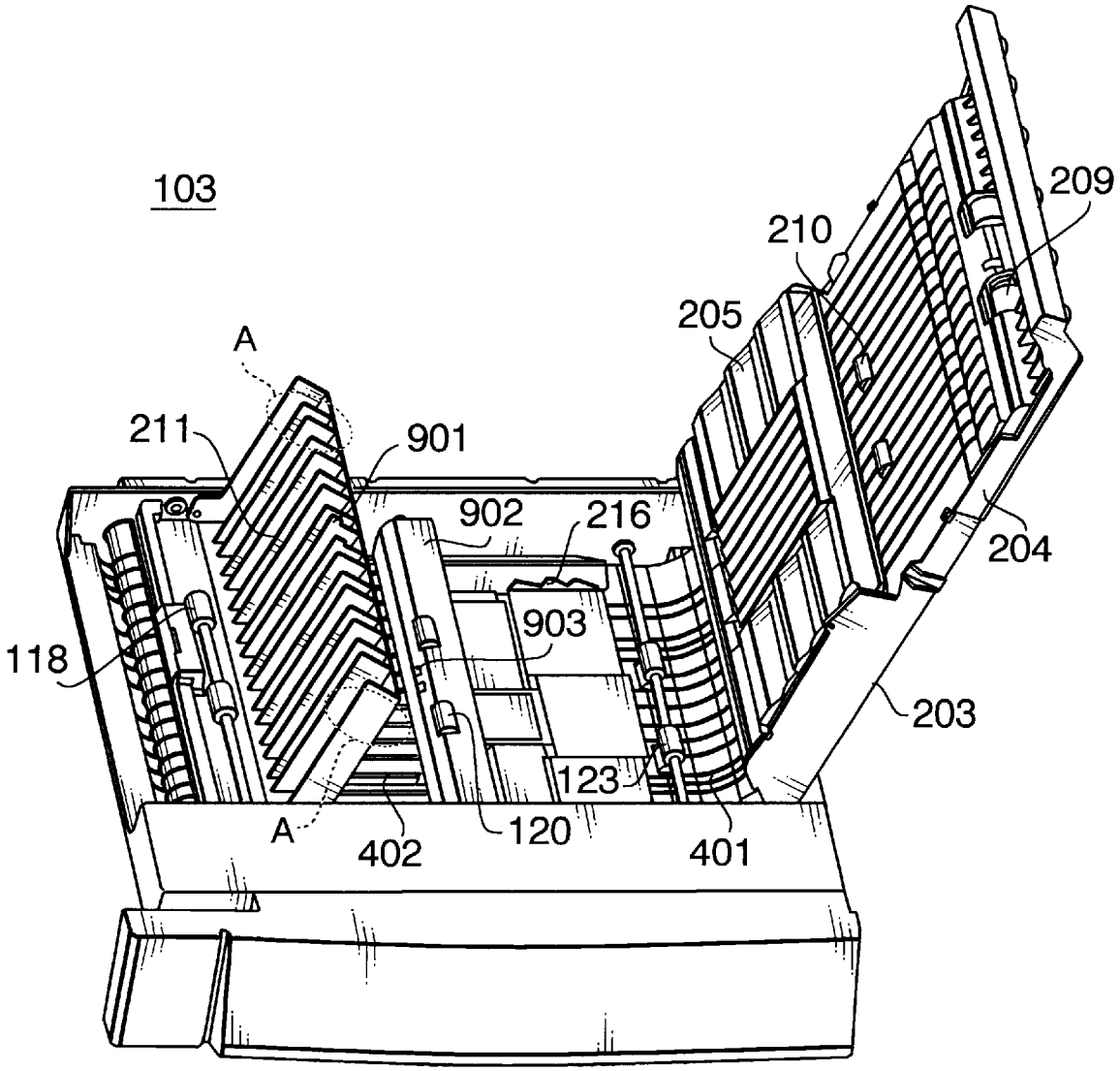
FIG. 10 is a perspective view showing the auto document unit with the upper cover opened and further with the lower cover opened in the copying apparatus according to the above embodiment.

The holding means and bend preventing means will be described below with reference to FIGS. 10 to 12. FIG. 10 is a perspective view of auto document unit 103 under a condition explained in FIG. 6.

As shown in FIG. 10, the holding means is comprised of projecting portions 901 provided in ribs 702 on the right side of lower cover 211, and groove sections 903 which receive corresponding projecting portions 901, and which are provided on supporting member 902 that exposes inverting roller 120 while forming the lower surface of upper path 201.

Figure 11:
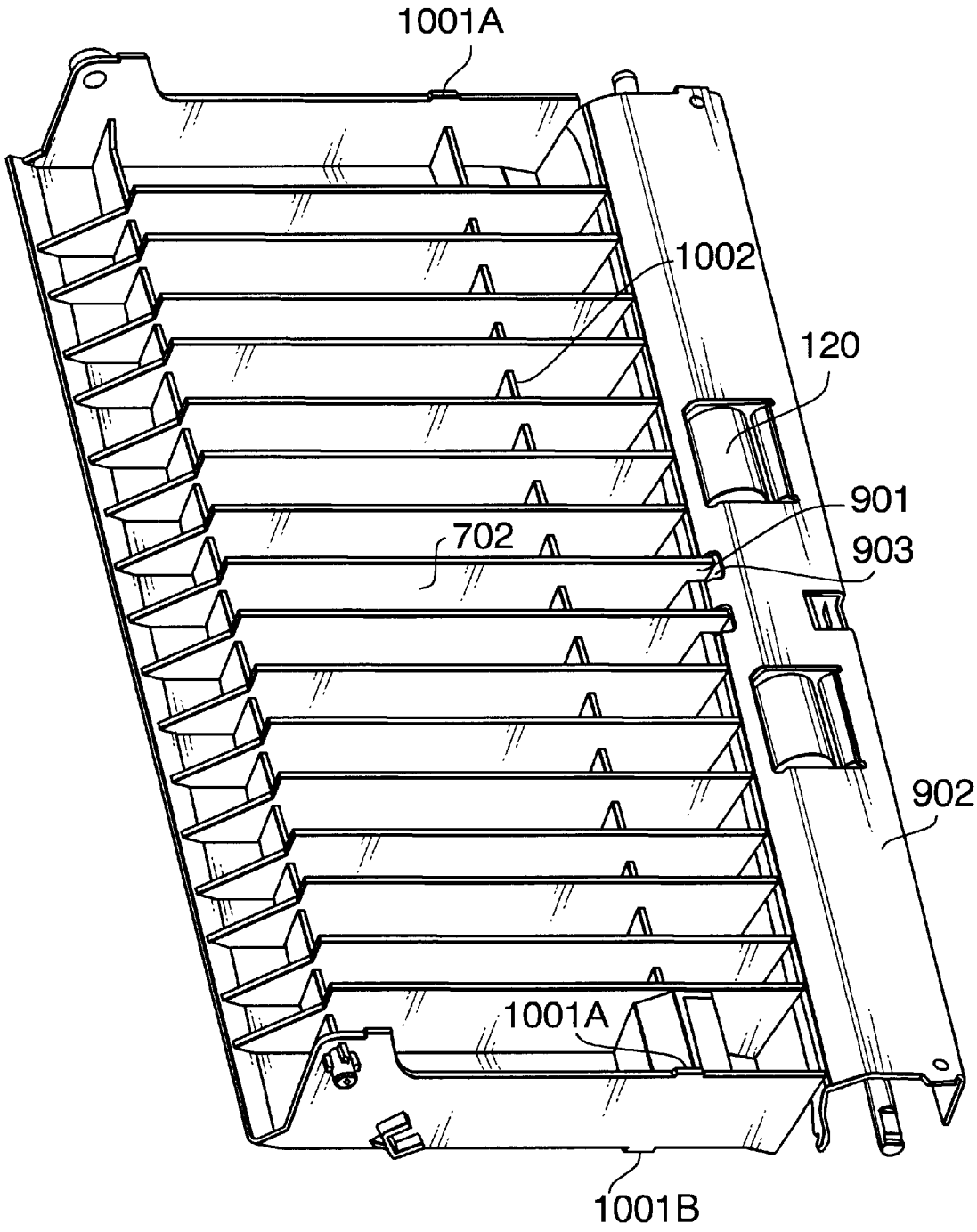
FIG. 11 is an enlarged view showing the auto document unit with the lower cover closed in the copying apparatus according to the above embodiment.

FIG. 11 shows a condition that lower cover 211 is closed and projecting portions 901 are inserted into corresponding groove sections 903. As shown in FIG. 11, projecting portions 901 are provided by extending two ribs 702 to the right side that are disposed at the center among ribs 702 provided on lower cover 211. Two groove sections 903 are provided at respective positions corresponding to projecting portion 901 in the vicinity of the center of supporting member 902.

Projecting portions 901 move into groove sections 903 and are at their lower end portions brought into contact with bottoms of groove sections 903, whereby lower cover 211 is held at a constant position. As a result, lower cover 211 is prevented from falling down from the position.

Meanwhile, bend providing means is comprised of projecting portions provided at upper and lower portions at portions in lower cover 211 enclosed by broken line A shown in FIG. 10, and projecting portions which are brought into contact with the above-mentioned projecting portions and which are provided in upper cover 203 and on the housing of auto document unit 103.

As shown in FIG. 11, projecting portions 1001A and 1001B provided respectively at upper and lower portions of lower cover 211 are disposed at positions at the right-hand portions of opposite side surfaces of lower cover 211. These projecting portions 1001A and 1001B are formed to project slightly upwardly or downwardly from the side surface of lower cover 211. Between one pair of projecting portions 1001A and 1001B and another pair of projecting portions 1001A and 1001B is provided reinforce rib 1002 for reinforcing lower cover 211. Lower cover 211 is further prevented from bending by reinforce rib 211.

FIG. 12 is used to explain the relationship between projecting portions 1001A and 1001B provided in lower cover 211 and the projecting portions provided in upper cover 203 and the housing of auto document unit 103. FIG. 12A shows a view of section taken along solid line B—B in the upper plan view shown in FIG. 9. FIG. 12B shows a view of section taken along solid line C—C in the upper plan view shown in FIG. 9. In addition, upper cover 203 is closed in FIG. 12. Therefore, pressing means 802 is in contact with contact member 801 and presses upper cover 203 downwardly.

Projecting portion 1101 provided in upper cover 203 and projecting portion 1102 provided on the housing of auto document unit are in contact with respectively projecting portion 1001A and 1001B provided in lower cover 211 with upper cover 203 closed as shown in FIGS. 12A and 12B.

These projecting portions provided in lower cover 211, upper cover 203, etc. are in contact with corresponding ones below spring 803 to which pressing means 802 applies a force as shown in FIG. 12A. These projecting portions are in contact with corresponding ones at opposite end portions of lower cover 211 and nip lower cover 211 vertically. Meanwhile, the holding means comprised of projecting portions 901 and groove sections 903 prevent lower cover 211 from falling down in the vicinity of the center of lower cover 211. Lower cover 211 is nipped at opposite ends, while being prevented from falling down in the vicinity of its center. The center area of lower cover 211 is thereby prevented from bending downwardly.

The holding means is thus provided that holds lower cover 211 at the center. Meanwhile, bend preventing means is provided that prevents lower cover 211 from bending, by nipping the opposite ends of lower cover 211 upwardly and downwardly. Further, pressing means 801 of upper cover 203 is provided at a position corresponding to the bend preventing means, whereby pressing means 802 nips the opposite ends of lower cover 211 upwardly and downwardly through the bend preventing means, and is thereby also provided with the function for preventing lower cover 211 from bending. In other words, one member, namely, pressing means 802 has two functions, whereby it is possible to decrease the number of parts corresponding to an eliminated part. It is thereby possible to simplify a configuration of the apparatus.

The case is herein described that lower cover 211 is nipped upwardly and downwardly. However, this embodiment is not limited to this case, and almost the same effectiveness is obtained by pressing lower cover 211 only downwardly from an upper portion.

The explanation is next given of movement of recording paper inside auto document unit 103 of copying apparatus 100 with such a configuration.

FIGS. 13 to 16 are sectional side views showing the movement of recording paper taken into auto document unit 103. In addition, a case is described that auto document unit 103 enables three sheets of recording paper (hereinafter referred to as "A4-sized sidewise recording paper) with a size of A4 (length: 297 mm, width: 210 mm) that is defined in Japanese Industrial Standard to circulate therein. In auto document unit 103 the behavior of the recording paper is controlled by sensors S1 to S4 shown in FIG. 13. In addition, in FIGS. 13 to 16 reference numerals assigned to the recording paper is indicative of an order in which the paper enters auto document unit 103.

Figure 13:
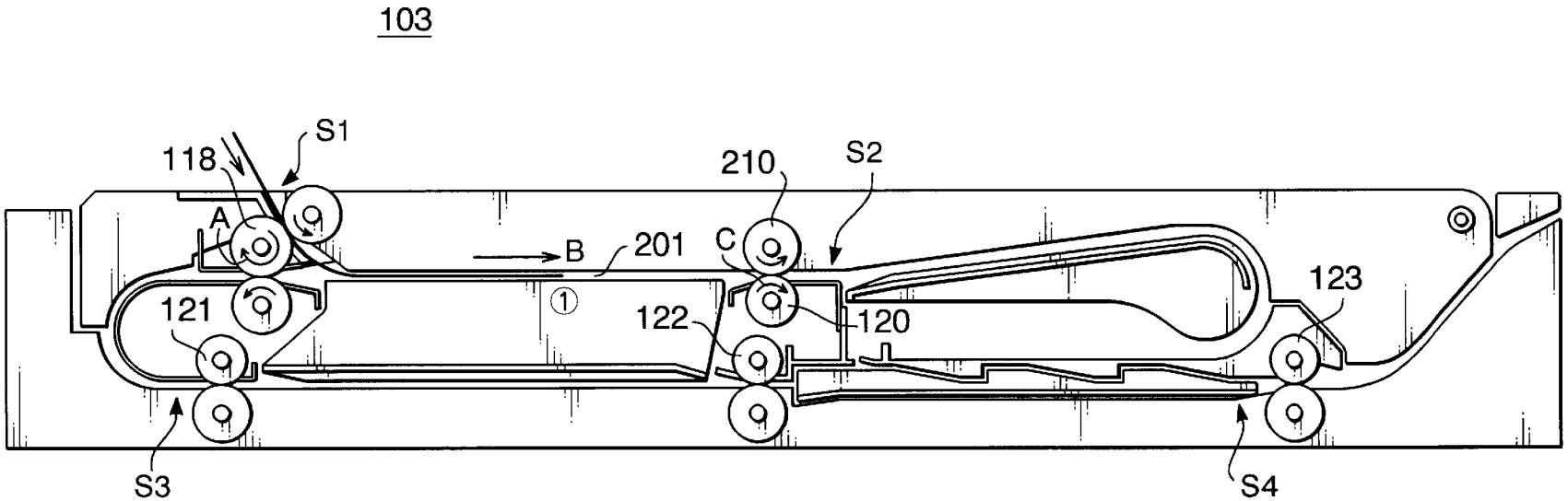
FIG. 13 is a sectional side view showing the movement of recording paper taken in the auto document unit in the copying apparatus according to the above embodiment.

FIG. 13 shows a condition that a first sheet of recording paper (herein referred to as "recording paper ①") is taken into inverting path 119 in auto document unit 103 from image forming section 102. When recording paper ① is fed from image forming section 102, storing roller 118 rotates in the direction shown by arrow A. The recording paper ① is thereby conveyed in the direction shown by arrow B on upper path 201. At this point inverting roller 120 is rotating in the direction shown by arrow C.

Figure 14:
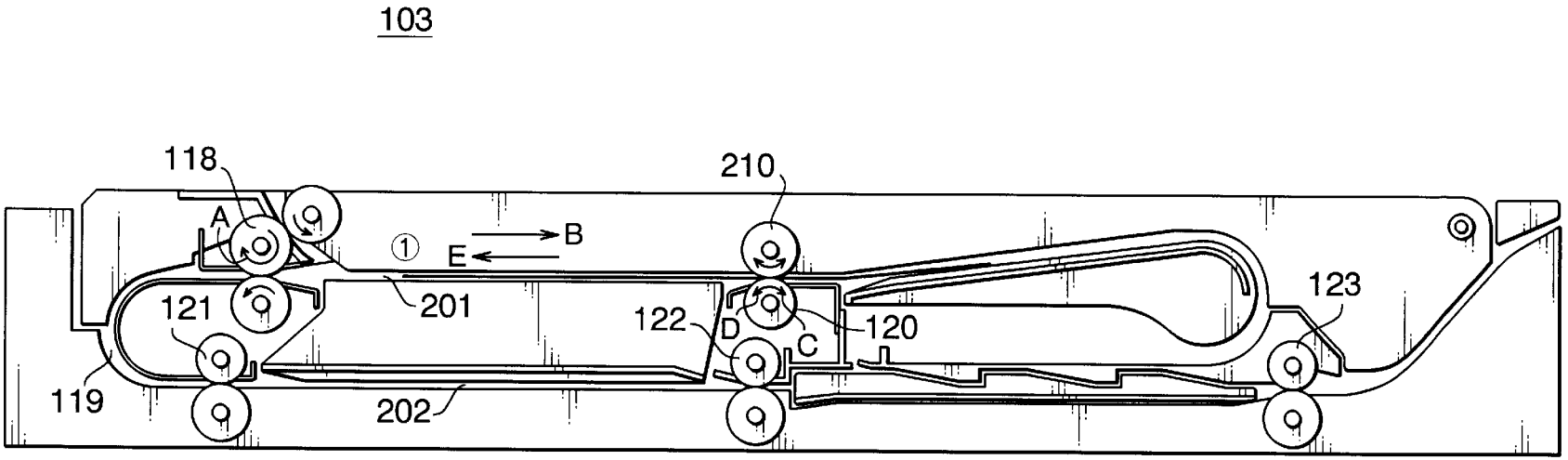
FIG. 14 is another sectional side view showing the movement of recording paper taken in the auto document unit in the copying apparatus according to the above embodiment.

When the recording paper ① is fed to upper path 201 and is completely taken into auto document 103, inverting roller 120 rotates in the direction shown by arrow D as shown in FIG. 14. The recording paper ① is thereby conveyed in the direction shown by arrow E on upper path 201. At this point storing roller 118 is still rotating in the direction shown by arrow A.

After the recording paper ① is conveyed in the direction shown by arrow E by inverting roller 120 and storing roller 118, the direction for feeding the recording paper ① is changed to turn the paper to the right side of auto document unit 103 along the form of inverting path 119. The recording paper ① is thereby fed to lower path 202.

Figure 15:
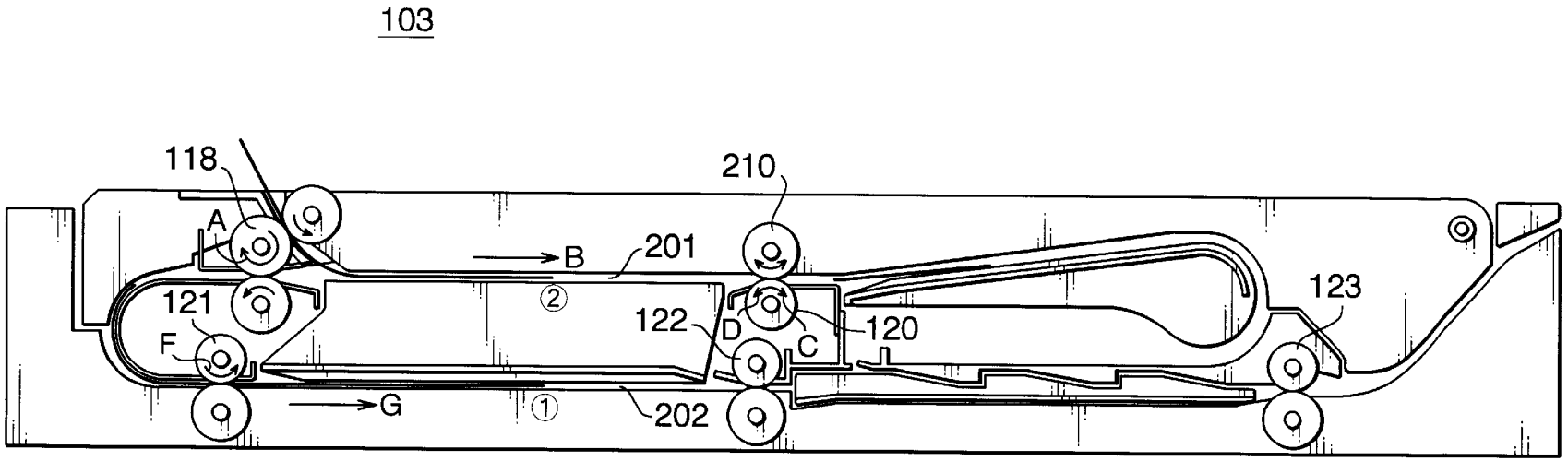
FIG. 15 is another sectional side view showing the movement of recording paper taken in the auto document unit in the copying apparatus according to the above embodiment.

At this point first discharging roller 121 rotates in the direction shown by arrow F in FIG. 15. The recording paper ① is thereby conveyed in the direction shown by arrow G. When the recording paper ① is conveyed in the direction shown by arrow G and a rear end of the recording paper ① passes below inverting roller 120, inverting roller 120 rotates again in the direction shown by arrow C. When inverting roller 120 thereby rotates in the direction shown by arrow C, the recording paper ② is fed to auto document unit 103 from image forming section 102.

When the recording paper ② is conveyed in the same way as the recording paper ① by inverting roller 120 and storing roller 118 and a rear end of the recording paper ② passes below inverting roller 120, inverting roller 120 rotates again in the direction shown by arrow C, and in the same way as described previously, recording paper ③ is fed to auto document unit 103 from image forming section 102.

Figure 16:
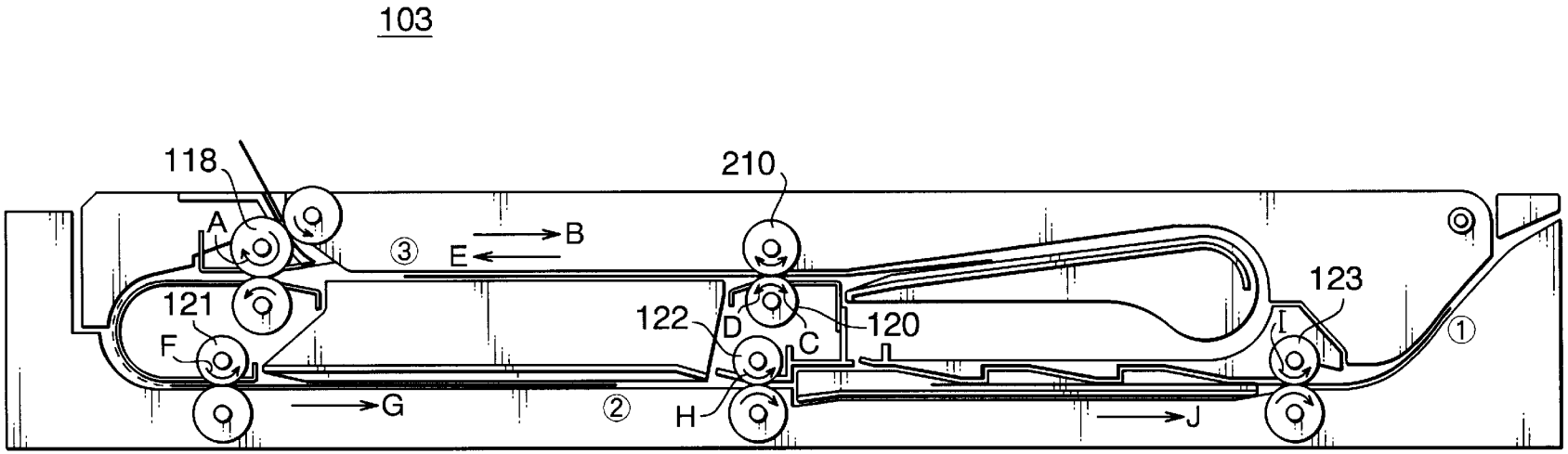
FIG. 16 is another sectional side view showing the movement of recording paper taken in the auto document unit in the copying apparatus according to the above embodiment.

At this point the recording paper ① is, as shown in FIG. 16, conveyed in the direction shown by arrow J by second discharging roller 122 and third discharge roller 123 rotating respectively in the directions shown by arrow H and by arrow I. When the recording paper ① arrives at a predetermined position, second discharging roller 122 and third discharging roller 123 stop their rotation. The feeding of the recording paper ① is thereby stopped.

At this point the recording paper ① stops at the predetermined position to undergo correction of the incline due to the feeding. The correction of recording-paper incline will be described below with reference to FIGS. 17 to 19.

Figure 17:
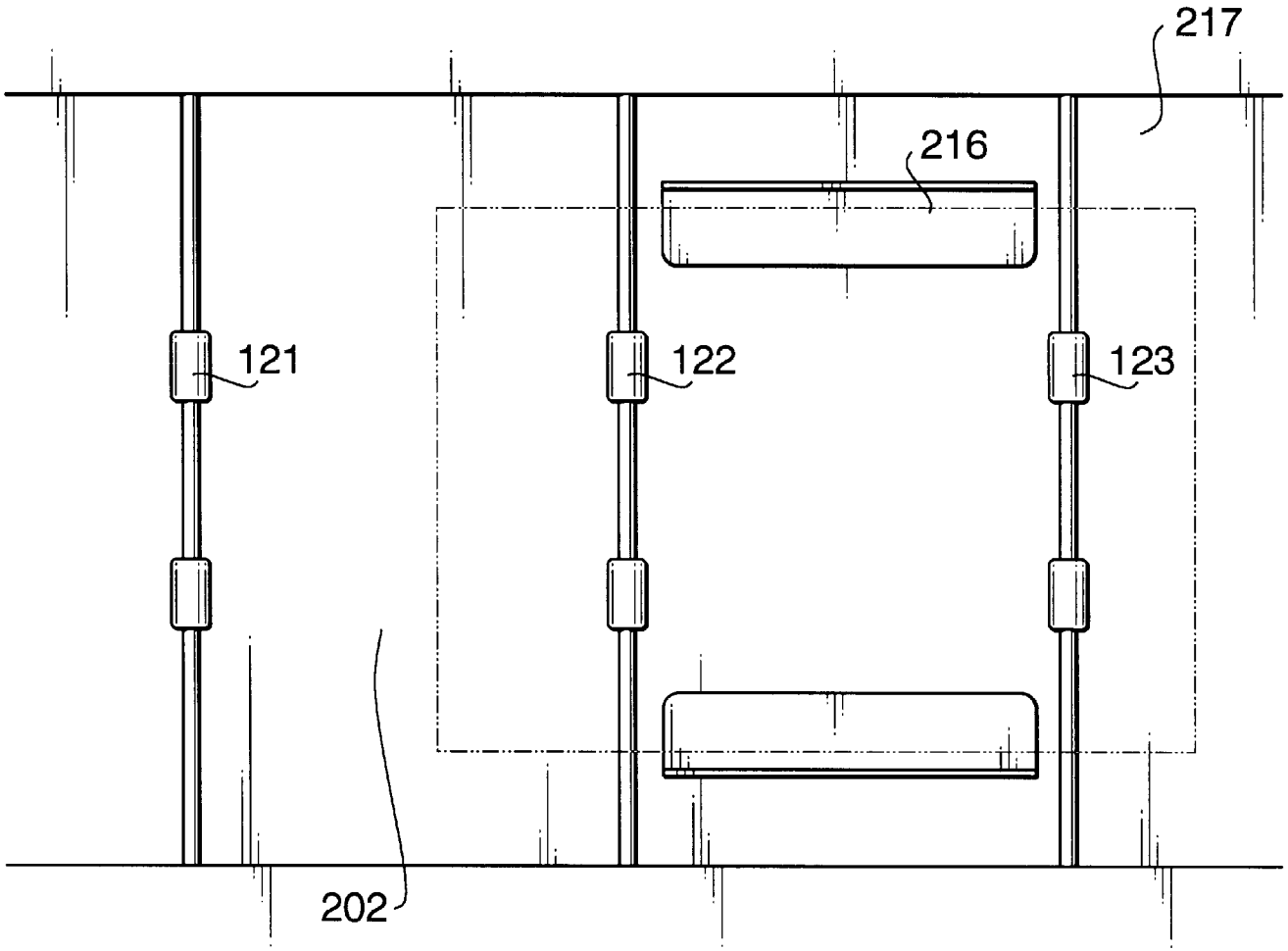
FIG. 17 is an upper plan view showing the recording paper stopping at a predetermined position on a lower path of the auto document unit in the copying apparatus according to the above embodiment.

FIG. 17 is an upper plan view showing the recording paper stopping at the predetermined position on lower path 202 of auto document unit 103. As shown in FIG. 17, the recording paper is controlled to stop at the position where its center of gravity corresponds to the center of incline correcting guides 216.

In the case where incline correcting guides 216 are used to correct the incline of recording paper, the guides 216 of long size are capable of correcting the incline relatively properly at any position of the recording paper. However, a case often arises that the length of each incline correcting guides 216 is not made sufficiently long due to restrictions on the mechanism and requirement for miniaturizing the apparatus. When incline correcting guides 216 are short in length, it sometimes happens that correcting the incline at the front end of the recording paper results in that the incline is not corrected adequately to the rear end of the recording paper.

In auto document unit 103, as described previously, the position at which the front end of the recording paper stops is controlled so that incline correcting guides 216 correspond to the center of gravity of the recording paper, whereby incline correcting guides 216 correct the incline at the position corresponding to the center of gravity of the recording paper. The effectiveness is thereby provided from the front end to the rear end of the recording paper even when incline correcting guides 216 are short in length. It is thus possible to correct the incline properly.

Further, in auto document unit 103, following rollers 214 and 215 opposite respectively to second discharging roller 122 and third discharging roller 123 move upwardly and downwardly, whereby the incline of the recording paper is corrected effectively.

Figure 18A:
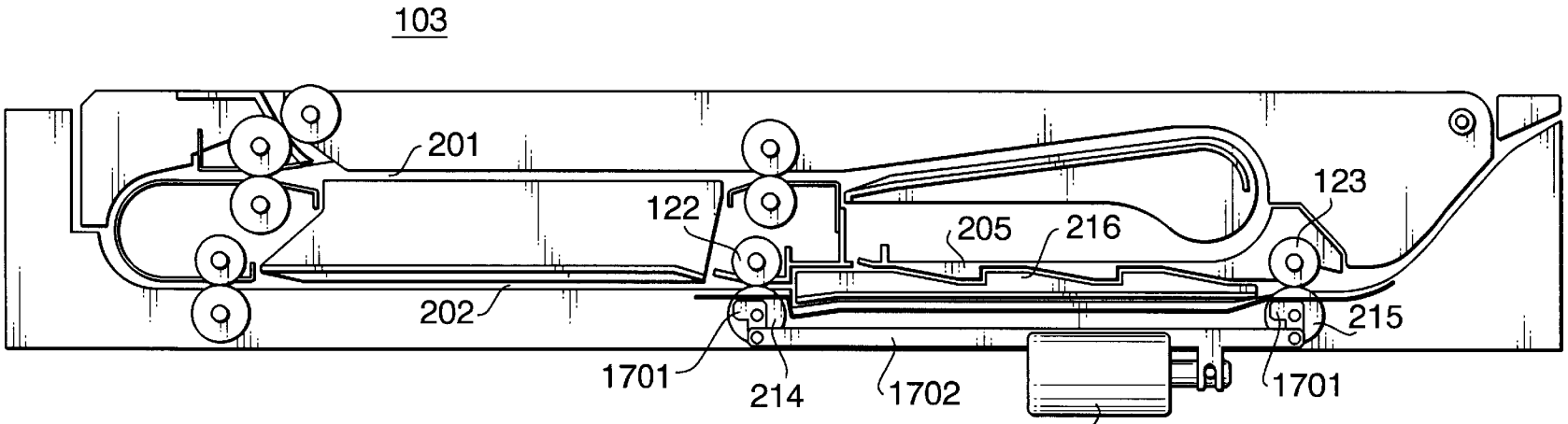
FIG. 18A is a section side view showing following rollers before moving in the auto document unit in the copying apparatus according to the above embodiment.
Figure 18B:
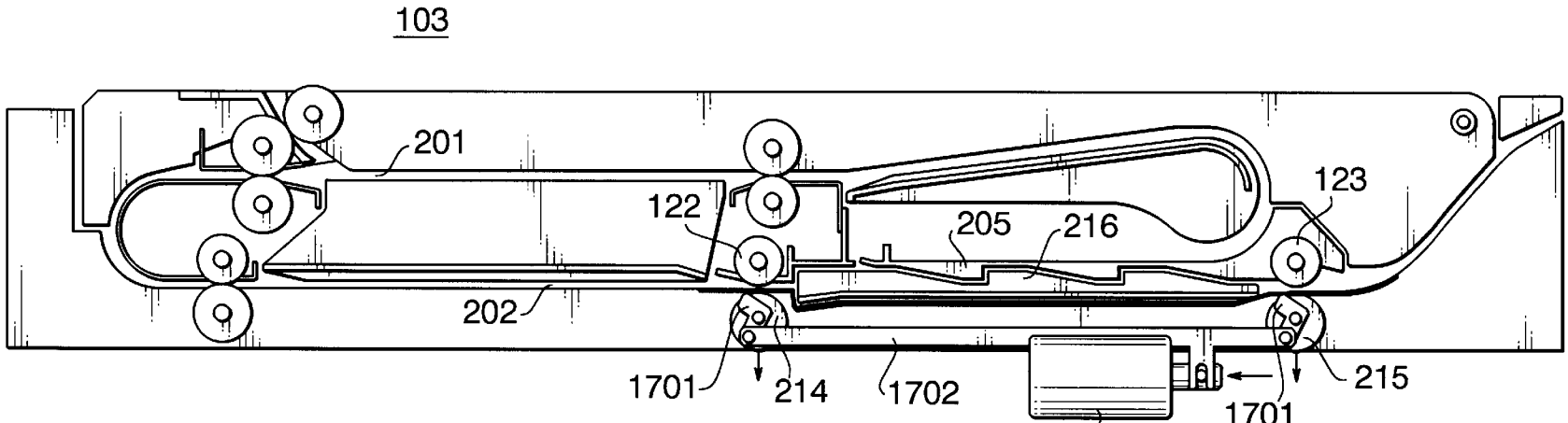
FIG. 18B is a section side view showing following rollers after moving in the auto document unit in the copying apparatus according to the above embodiment.

FIG. 18 shows sectional side views of auto document unit 103 showing movements of following rollers 214 and 215. FIG. 18A shows a condition before following rollers 214 and 215 move, while FIG. 18B shows a condition after following rollers 214 and 215 move.

In FIG. 18, contact members 1701 are attached to both side surfaces of following rollers 214 and 215. Contact members 1701 are attached to respective axes of following rollers 214 and 215 rotatably within a predetermined range around the center. Each contact member 1701 has the form, as shown in the figure, such that its upper end bends to the left side of copying apparatus 100.

Both contact members 1701 attached respectively to following rollers 214 and 215 are connected on their lower end portions by connecting bar 1702. Connecting bar 1702 is further connected to solenoid 1703 disposed under the bar 1702. Solenoid 1703 moves connecting bar 1702 to the left side of auto document unit 103. Connecting bar 1702 moving leftward rotates contact member 1701.

FIG. 18A shows a condition that solenoid 1703 does not move connecting bar 1702. At this point a projecting portion of each contact member 1701 is not in contact with the housing of auto document unit 103. When solenoid 1703 moves connecting bar 1702 leftward from this condition, as shown in FIG. 18B, lower end portions of both contact members 1701 are pulled leftward. Contact members 1701 thereby rotate, and their bent portions are brought into contact with the housing of auto document unit 103. Following rollers 214 and 215 thereby move downwardly. At this point the recording paper is released that is placed between second discharging roller 122 and following roller 214, and between third discharge roller 123 and following roller 215. The recording paper is thereby in a condition enabling the paper to move freely on lower path 202. Incline correcting guides 216 correct the incline of recording paper in this condition.

With reference to FIG. 19, the order will be described below in which the incline of recording paper is corrected. In addition, FIG. 19 shows only third discharging roller 123 and following roller 215, while omitting contact member 1701, etc. Second discharging roller 122 and following roller 214 move respectively in the same way as third discharging roller 123 and following roller 215.

Figure 19A:
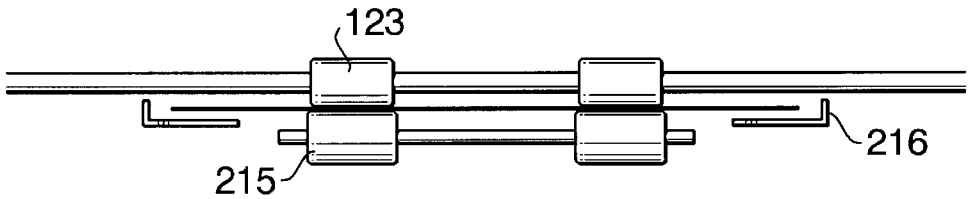
FIG. 19A is a principal enlarged view showing the recording paper stopping at the predetermined position in the auto document unit in the copying apparatus according to the above embodiment.
Figure 19B:
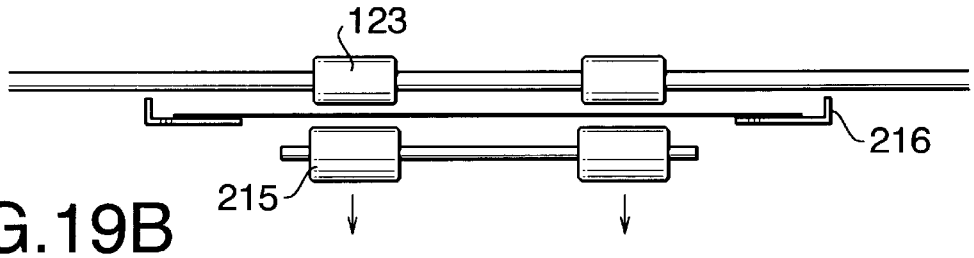
FIG. 19B is a principal enlarged view showing the following rollers after moving downwardly in the auto document unit in the copying apparatus according to the above embodiment.

FIG. 19A shows a condition that conveyed recording paper stops at the predetermined position on lower path 202. This condition is explained in FIG. 16. From this condition, as described previously, following roller 215 moves downwardly as shown in FIG. 19B.

Figure 19C:
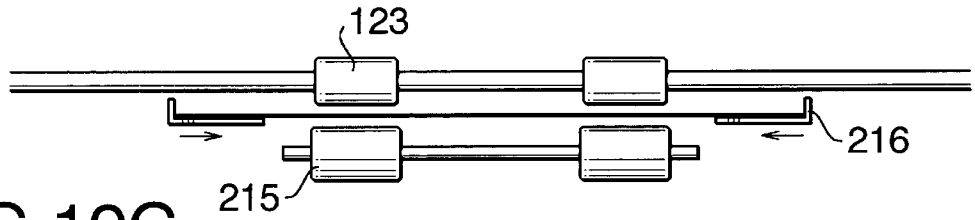
FIG. 19C is a principal enlarged view showing incline correcting guides each reaching a predetermined position in the auto document unit in the copying apparatus according to the above embodiment.

When following roller 215 moves downwardly and the recording paper is released, as shown in FIG. 19C, incline correcting guides 216 move to respective predetermined positions by a driving motor not shown. The incline of the recording paper is thereby corrected. Incline correcting guides 216 change a position at which the incline is corrected corresponding to a size of the recording paper. The incline of the recording paper is thereby corrected.

Figure 19D:
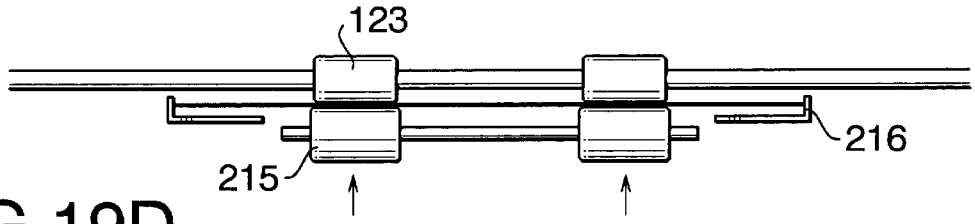
FIG. 19D is a principal enlarged view showing the following rollers after moving upwardly in the auto document unit in the copying apparatus according to the above embodiment.
Figure 19E:
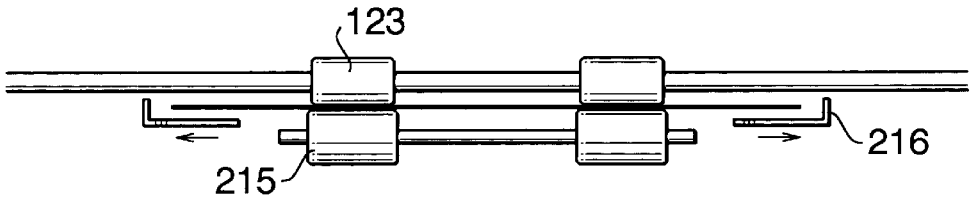
FIG. 19E is a principal enlarged view showing the incline correcting guides each moving to a side of a side surface to release side ends of the recording paper in the auto document unit in the copying apparatus according to the above embodiment.

Under the condition that incline correcting guides 216 hold side ends of the recording paper, as shown in FIG. 19D, following roller 215 moves upwardly. The recording paper is thus held by third discharging roller 123 and following roller 215. After that, the recording paper is fed out by the rotation of third discharging roller 123, and maintains in incline the condition shown in FIG. 19D until the paper reaches intermediate roller 109 or register roller 110. The recording paper is thus prevented from being conveyed while being inclined. Then, as shown in FIG. 19E, incline correcting guides 216 move to respective side surfaces, and the side ends of the recording paper are released. Incline correcting guides 216 escape to respective positions that do not prevent next recording paper from entering.

Thus, auto document unit 103 first stops the recording paper at a predetermined position to correct the incline of the paper. Next, following roller 215 that holds the recording paper is spaced apart from the paper. Then, incline correcting guides 216 are in contact with opposite ends of the recording paper to correct the incline of the recording paper. Following roller 215 is spaced apart from the recording paper when incline correcting guides 216 correct the inclines of opposite ends of the recording paper, and thereby do not interrupt the correction. Accordingly, incline correcting guides 216 are capable of correcting the incline of the recording paper properly.

In auto document unit 103, after incline correcting guides 216 correct the incline of the recording paper, following roller 215 is brought into contact with the recording paper again with the opposite ends of the recording paper held by incline correcting guides 216. Then, after the recording paper is conveyed, incline correcting guides 216 are spaced apart from the recording paper. Accordingly, it is possible to assuredly prevent the recording paper from inclining when following roller 215 makes contact with recording paper with the incline corrected.

Thus, in auto document unit 103, incline correcting guides 216 for correcting the incline of the recording paper are provided at a final area of inverting path 119 bent to form two pile-shaped upper and lower stages. The incline of the recording paper that is inverted while being passed through complicated paths is corrected at the final area of inverting path 119. The incline of the recording paper is thereby canceled when the recording paper is discharged from inverting path 119, whereby it is possible to form a proper image on the other side of the recording paper.

Figure 20:
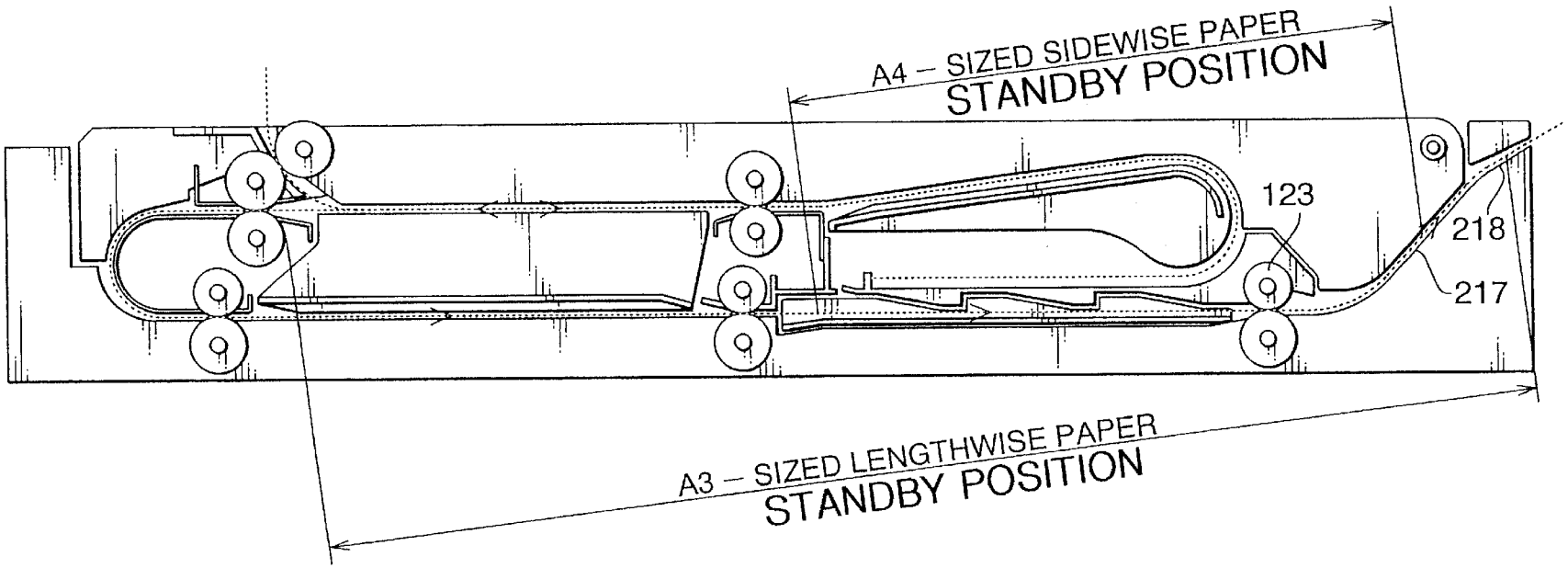
FIG. 20 is a sectional side view showing predetermined positions where the recording paper stops in the auto document unit in the copying apparatus according to the above embodiment.

The recording paper to undergo the incline correction stops as shown in FIG. 20. FIG. 20 shows a case that a sheet of A4-sized sidewise recording paper and another sheet of recording paper placed longitudinally (hereinafter referred to as "A3-sized lengthwise recording paper) with a size of A3 (length: 297 mm, width: 420 mm) defined in Japanese Industrial Standard are stopped at respective predetermined positions. The A3-sized lengthwise recording paper is set to stop at a position at which the front end of the recording paper exceeds first slope portion 217 and is about to reach second slope portion 218.

When the recording paper is returned from auto document unit 103 to image forming section 102, since image forming section 102 is positioned above auto document unit 103, the final area of inverting path 119 is sloped upwardly in auto document unit 103.

Meanwhile, in order to correct the incline of the recording paper, it is preferable to hold the recording paper flat from its front end to its rear end. However, the requirement for miniaturizing the apparatus disables the formation of a conveying path that holds the recording paper flat from its front end to its rear end. Therefore, it is necessary to correct the incline of the recording paper with its front end inclined upwardly.

In this case the front end of the recording paper tends to move back in the feeding direction by its weight. The recording paper thereby moves from the predetermined position for correcting the incline, whereby it is not possible to perform proper incline correction. Further, when the recording paper moves back, a loss arises in the conveying time corresponding to the backing, and the productivity in the double-sided printing deteriorates.

According to auto document unit 103, a flat conveying path is sloped upwardly from discharging roller 123 to a discharging opening. The slope angle is changed gently from a middle portion on the slope to the discharging opening. A3-sized sidewise recording paper thereby has a load on its front end. Therefore, it is possible to suppress the backing of the recording paper due to its weight. Accordingly, even when it is not possible to hold the recording paper flat from its front end to its rear end, the recording paper is capable of being prevented from moving from the predetermined position. It is thereby possible to correct the incline of the recording paper properly. Further, since the recording paper is prevented from moving back, it is possible to prevent the occurrence of a loss in the conveying time, and to improve the productivity in the double-sided printing.

Further as shown in FIGS. 10 and 18, second cover 205 corresponding to incline correcting guides 216 is provided in the form of waves along the feeding direction.

When the recording paper is stopped at a predetermined position corresponding to incline correcting guides 216, if the recording paper is spaced apart from the lower surface of inverting path 119, incline correcting guides 216 may enter under the recording paper, and thereby could not properly correct the incline of the recording paper.

According to auto document unit 103, second cover 205 corresponding to incline correcting guides 216 is made in the form of waves along the feeding direction. The recording paper is thereby drawn downwardly by second cover 205, whereby it is possible to prevent the recording paper from being spaced apart from the lower surface of inverting path 119. Accordingly, it is possible to assuredly prevent the occurrence of a situation that incline correcting guides 216 enter under the recording paper, and thereby cannot properly correct the incline of the recording paper.

In this embodiment is described the case that three sheets of A4-sized sidewise recording paper are circulated in auto document unit 103. However, a case arises that two or less sheets of the recording paper are circulated in auto document unit 103. When two or less sheets of the recording paper are circulated on inverting path 119, the recording paper is controlled to stop in an area covered by upper cover 203.

Specifically, when two sheets of the recording paper are circulated on inverting path 119, those are controlled to stop at positions of recording paper ① and recording paper ③ shown in FIG. 16. When one sheet of the recording paper is circulated on inverting path 119, the recording paper is controlled to stop at the position of recording paper ① shown in FIG. 16.

Thus, when the number of sheets of recording paper being circulated on inverting path 119 is less than a predetermined number that auto document unit 103 is capable of accommodating, the recording paper stops at a position on a conveying path that is exposed when upper cover 203 is opened. Accordingly, opening upper cover 203 enables the recording paper on inverting path 119 to be all removed. It is thereby possible to reduce an operation load on a user.

In the case where three sheets of the recording paper are circulated on inverting path 119, the recording paper is controlled so that two sheets stop at stopping positions as described above, and the other sheet stops at an area covered by lower cover 211.

Thus, when a predetermined number of sheets of recording paper that auto document unit 103 is capable of accommodating are circulated on inverting path 119, the other sheet of the recording paper stops at the area that is exposed when lower cover 211 is opened. Accordingly, opening lower cover 211 when necessary enables the recording paper on inverting path 119 to be all removed. It is thereby possible to reduce an operation load on a user.

In this embodiment is described the case that three sheets of A4-sized sidewise recording paper are circulated in auto document unit 103. Another case will be described next that recording paper of another size is circulated. FIG. 21 is a sectional side view of auto document unit 103 in which the recording paper of another size is circulated.

Figure 21A:
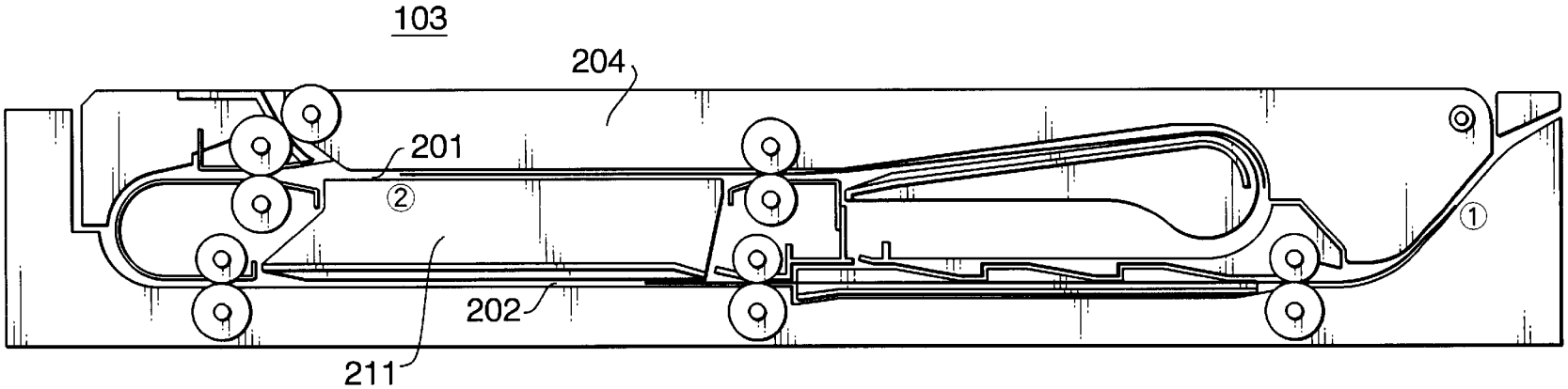
FIG. 21A is a sectional side view showing the auto document unit with recording paper of another size is circulated therein in the copying apparatus according to the above embodiment.
Figure 21B:
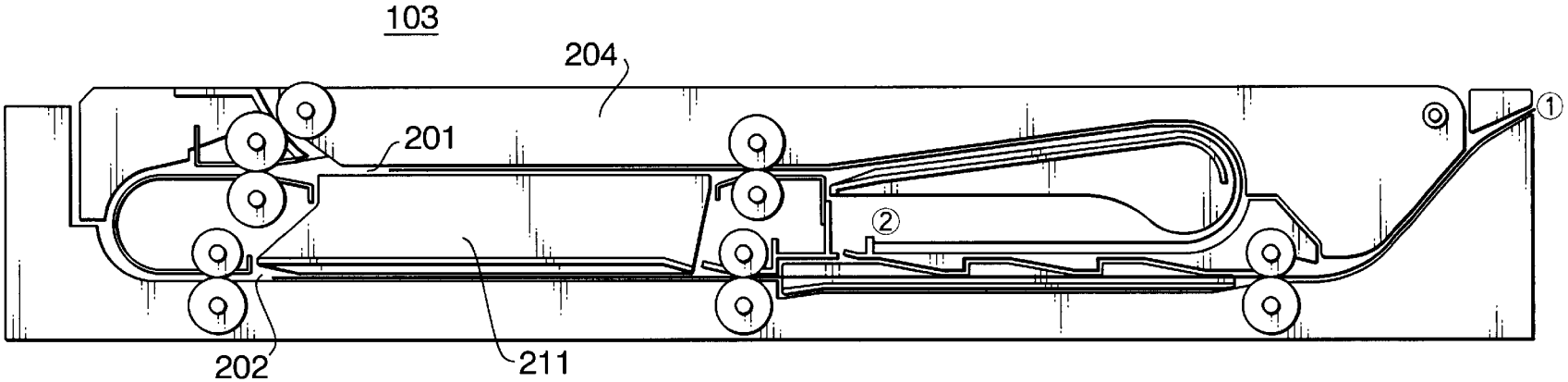
FIG. 21B is another sectional side view showing the auto document unit with recording paper of another size is circulated therein in the copying apparatus according to the above embodiment.

FIG. 21A shows a case that A4-sized lengthwise recording paper is circulated, while FIG. 21B shows a case that A3-sized lengthwise recording paper is circulated. In these cases, two sheets of recording paper are circulated in auto document unit 103, thereby achieving the double-sided printing.

Thus, according to copying apparatus 100 of this embodiment, when the recording paper is inverted upside down in the double-sided printing, a plurality of sheets of recording paper each with the same image formed on one side thereof are sequentially inverted and fed to image forming section 102 without being stacked, which differs from the conventional method. Therefore, when the double-sided printing of a plurality of sheets is performed on the same original, it is possible to largely reduce a period of time a first sheet of recording paper with images formed on both sides thereof is discharged outside the apparatus. Accordingly, it is possible to form images on both sides of the recording paper efficiently.

In this case, a plurality of sheets of recording paper are circulated at a plurality of portions on inverting path 119 bent to form two pile-shaped upper and lower stages. Therefore, when a paper jam occurs, it is necessary to remove the recording paper from the plurality of portions on inverting path 119, resulting in a complicated user operation. According to auto document unit 103, a cover covering inverting path 119 is composed of lower cover 211 covering a part of lower path 202, and upper cover 203 with first cover 204 covering upper path 201 and second cover 205 covering the other area of lower path 202 both integrated into the cover 203. It is thereby possible to expose almost all the area of upper path 201 and a part of lower path 202 at one time by opening upper cover 203. Further, it is possible to expose the left area of lower path 202 by opening lower cover 211 when necessary. Accordingly, even in the configuration where the recording paper is inverted on inverting path 119 bent to form two pile-shaped upper and lower stages, it is possible to decrease the number of times the cover is opened. It is thereby possible to greatly reduce an operation load on a user when a paper jam occurs.

Figure 22:
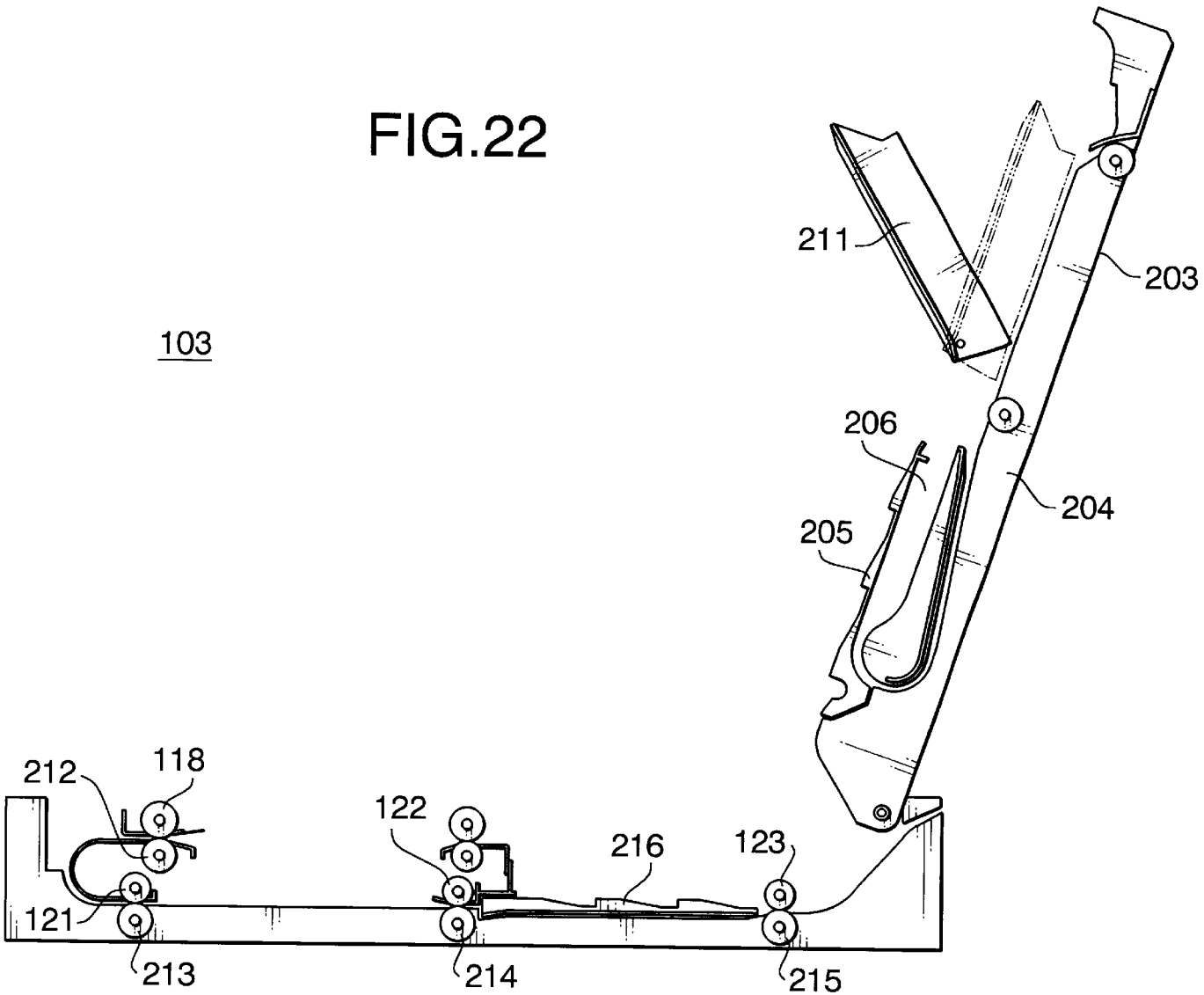
FIG. 22 is a sectional side view showing a modified example of the auto document unit in the copying apparatus according to the above embodiment.

FIG. 22 shows a modified example of auto document unit 103 that copying apparatus 100 according to this embodiment has. Auto document unit 103 shown in FIG. 22 is different from auto document unit 103 of this embodiment in a point lower cover 211 is attached to upper cover 203. Lower cover 211 is provided to enable itself to be opened and closed with respect to upper cover 203.

Since lower cover 211 that covers the other area of lower path 202 of inverting path 119 is thus provided to enable itself to be opened and closed with respect to upper cover 203, lower cover 211 is opened by its weight from upper cover 203 when a user opens upper cover 203, whereby the user is capable of exposing the entire area of inverting path 119 bent to form two pile-shaped upper and lower stages. It is thereby possible to greatly cancel the complicatedness on a user operation when a paper jam occurs.

According to the present invention as described above, a plurality of sheets of recording paper each with the same image formed on one side thereof are sequentially inverted and fed to an image forming section without being stacked. As a result, when the double-sided printing of a plurality of sheets is performed on the same original, it is possible to greatly reduce a period of time a first sheet of recording paper with images formed on both sides thereof is discharged outside the apparatus, whereby it is possible to form images on both sides of the recording paper efficiently.

The present invention is not limited to the above described embodiments, and various variations and modifications may be possible without departing from the scope of the present invention.

This application is based on the Japanese Patent Application No.2000-340545 filed on Nov. 8, 2000, entire content of which is expressly incorporated by reference herein.

What is claimed is:

1. A copying apparatus having an image forming section that forms an image on recording paper and an auto document unit that inverts the recording paper with the image formed thereon to return to said image forming section, said auto document unit comprising:

an inverting path which receives the recording paper with the image on one side thereof from said image forming section, and which inverts the recording paper along a path bent to form upper and lower stages;

a plurality of rollers that feed the recording paper while adjusting intervals between a plurality of sheets of the recording paper at predetermined positions on said inverting path;

a lower cover that covers a part of a lower path of said inverting path; and an upper cover having a first cover that covers an upper path of said inverting path and a second cover that covers an other area of said lower path of said inverting path except the part that said lower cover covers, said first cover and said second cover being integrated into said upper cover.

2. The copying apparatus according to claim 1, wherein in order to enable said inverting path to store the recording paper with an extended length, said upper cover has between said first cover and said second cover a storing section which is integrated into said upper cover, and which bends a front end of the recording paper taken therein to store.

3. The copying apparatus according to claim 2, wherein said first cover of said upper cover forms an upper surface of said upper path of said inverting path, while said storing section forms a part of a lower surface of said upper path of said inverting path.

4. The copying apparatus according to claim 1, wherein said second cover of said upper cover forms a part of an upper surface of said lower path of said inverting path.

5. The copying apparatus according claim 1, wherein said lower cover forms on its upper surface a part of a lower surface of said upper path of said inverting path, while forms on its lower surface a part of an upper surface of said lower path of said inverting path.

6. The copying apparatus according to claim 1, wherein said lower cover is disposed at a position enabling itself to be opened only when said upper cover is opened, while is attached to said auto document unit to have a maximum opening angle enabling itself to fall down by a weight thereof when said lower cover is opened to an angle within the maximum opening angle.

7. The copying apparatus according to claim 1, wherein when the number of sheets of the recording paper being circulated on said inverting path is less than the maximum number of sheets capable of being accommodated on said inverting path, each recording paper being circulated on said inverting path stops at an area that said upper cover covers.

8. The copying apparatus according to claim 7, wherein the number of sheets of the recording paper being circulated on said inverting path is the same as the maximum number of sheets capable of being stored on said inverting path, recording paper except the recording paper that stops at the area that said upper cover covers stops at an area that said lower cover covers.

9. A copying apparatus having an image forming section that forms an image on recording paper and an auto document unit that inverts upside down the recording paper with the image formed thereon to return to said image forming section, said auto document unit comprising:

an inverting path which takes in the recording paper with the image on one side thereof from said image forming section, and which inverts the recording paper upside down by a path bent to form upper and lower stages;

an plurality of rollers that feeds the recording paper while adjusts intervals between a plurality of sheets of the recording paper at predetermined positions on said inverting path;

an upper cover having a first cover that covers an upper path of said inverting path and a second cover that covers a part of a lower path of said inverting path, said first cover and said second cover being integrated into said upper cover; and a lower cover which is attached to said upper cover to be opened or closed with respect to said upper cover, and which covers an other area of said lower path of said inverting path except the part that said second cover covers, wherein said lower cover is opened from said upper cover by a weight thereof when said upper cover is opened.

10. A copying apparatus having an image forming section that forms an image on recording paper and an auto document unit that inverts upside down the recording paper with the image formed thereon to return to said image forming section, said auto document unit comprising:

an inverting path which takes in the recording paper with the image on one side thereof formed in said image forming section, and which inverts the recording paper upside down by a path bent to form upper and lower stages;

a plurality of feeding rollers that feeds the recording paper while adjusts intervals between a plurality of sheets of the recording paper at predetermined positions on said inverting path;

a discharging roller that discharges the recording paper from said inverting path; and an incline correcting guide that corrects an incline of the recording paper before said discharging roller discharges the recording paper.

11. The copying apparatus according to claim 10, further comprising control means for controlling said discharging rollers and said incline correcting guide, wherein said control means stops the recording paper at a predetermined position before said discharging roller, moves said discharging roller to be spaced apart from the recording paper, corrects the incline of the recording paper with said incline correcting guide, contacts said discharging roller with the recording paper, with opposite ends of the recording paper held by said incline correcting guide, and moves said incline correcting guide to be spaced apart from the recording paper.

12. The copying apparatus according to claim 10, wherein a form of an upper surface of a lower path of said inverting path at an area corresponding to said incline correcting guide is made in the form of waves along a direction for feeding the recording paper.

13. The copying apparatus according to claim 12, wherein the upper surface of said lower path of said inverting path is formed of a plurality of shapes each sloping downwardly and rearwardly to be in the form of waves along the direction for feeding the recording paper.

14. The copying apparatus according to claim 10, wherein ribs are provided on said inverting path at areas before and after an area corresponding to said incline correcting guide, along the direction for feeding the recording paper, and said ribs are provided vertically to said inverting path at a center portion of said inverting path, and are formed to have a gentler slope on their inner side thereof as being spaced apart from the center portion.

15. The copying apparatus according to claim 10, wherein in said inverting path, a flat path is sloped in a vicinity of a recording-paper discharging opening upwardly towards said discharging opening, and is sloped more gently before reaching said discharging opening.

16. The copying apparatus according to claim 11, wherein said control means switches the position at which the recording paper is stopped so that a center of said incline correcting guide is disposed around a center of gravity of the recording paper corresponding to a length of the recording paper.

17. A copying apparatus having an image forming section that forms an image on recording paper and an auto document unit that inverts upside down the recording paper with the image formed thereon to return to said image forming section, said auto document unit comprising:

an inverting path which takes in the recording paper with the image on one side thereof formed in said image forming section, and which inverts the recording paper upside down by a path bent to form upper and lower stages;

a plurality of feeding rollers that feeds the recording paper while adjusts intervals between a plurality of sheets of the recording paper at predetermined positions on said inverting path;

a lower cover that covers a part of a lower path of said inverting path;

an upper cover having a first cover that covers an upper path of said inverting path and a second cover that covers an other area of said lower path of said inverting path except the part that said lower cover covers, said first cover and said second cover being integrated into said upper cover;

a discharging roller that discharges the recording paper from said inverting path; and an incline correcting guide that corrects an incline of the recording paper before said discharging roller discharges the recording paper, wherein said second cover of said upper cover forms a part of an upper surface of said lower path of said inverting path, while forms an area corresponding to said incline correcting guide, and has on its surface faced to the recording paper a form of waves along a direction for feeding the recording paper.

18. The copying apparatus according to claim 17, wherein the upper surface of said lower path of said inverting path is formed of a plurality of shapes each sloping downwardly and rearwardly to be in the form of waves along the direction for feeding the recording paper.

19. A copying apparatus having an image forming section that forms an image on recording paper and an auto document unit that inverts upside down the recording paper with the image formed thereon to return to said image forming section, said auto document unit comprising:

an inverting path which takes in the recording paper with the image on one side thereof from said image forming section, and which inverts the recording paper upside down by a path bent to form upper and lower stages;

a plurality of feeding rollers that feeds the recording paper while adjusting intervals between a plurality of sheets of the recording paper at predetermined positions on said inverting path;

a lower cover that covers a part of a lower path of said inverting path;

an upper cover having a first cover that covers an upper path of said inverting path and a second cover that covers an other area of said lower path of said inverting path except the part that said lower cover covers, said first cover and said second cover being integrated into said upper cover; and an incline correcting guide that corrects an incline of the recording paper being passed through said lower path, wherein said lower cover has a plurality of first ribs with the same form, said first ribs form an upper surface of said lower cover and form a part of a lower surface of said upper path of said inverting path, while further has the lower surface of itself, which forms a part of an upper surface of said lower path of said inverting path, said second ribs are formed to have a gentler slope on their inner side as being spaced apart from the center portion.

20. The copying apparatus according to claim 19, herein an upper surface of said lower path of said inverting path is formed of a plane that said lower cover has, said second ribs are provided downwardly on said plane, and a lower surface of said upper path is composed of frond ends of said first ribs provided upwardly on said plane.

21. A copying apparatus having an image forming section that forms an image on recording paper, an auto document unit that inverts upside down the recording paper with the image formed thereon to return to said image forming section, and first pressing means for pressing downwardly said auto document unit, said auto document unit comprising:

an inverting path which takes in the recording paper with the image on one side thereof formed in said image forming section, and which inverts the recording paper upside down by a path bent to form upper and lower stages;

a plurality of driving rollers which is disposed on said inverting path, and which rotates while being driven by a driving source;

a plurality of following rollers which makes contact with said driving rollers under a predetermined pressure force, and which rotates according to said driving rollers;

a lower cover that covers a part of a lower path of said inverting path;

an upper cover which has a first cover that covers an upper path of said inverting path and a second cover that covers an other area of said lower path of said inverting path except the part that said lower cover covers, said first cover and said second cover being integrated into said upper cover, and which supports part of said driving rollers or part of said following rollers; and second pressing means which is provided on an upper surface of said upper cover, and which presses said upper cover downwardly by being pressed from an upper portion by said first pressing means.

22. The copying apparatus according to claim 21, wherein said lower cover has in a vicinity of a center thereof holding means for holding said lower cover to prevent said lower cover from falling lower than a predetermined position, and said upper cover has at a position corresponding to said second pressing means on its lower surface bend preventing means for pressing opposite ends of said lower cover from an upper portion to prevent said lower cover from bending.

23. The copying apparatus according to claim 21, further comprising holding means for holding said lower cover to prevent said lower cover from falling lower than a predetermined position in a vicinity of a center of said lower cover; and bend preventing means for nipping opposite ends of said lower cover downwardly and upwardly to prevent said lower cover from bending at a position corresponding to said second pressing means.

* * * * *

UNITED STATES PATENT AND TRADEMARK OFFICE

CERTIFICATE OF CORRECTION

PATENT NO. : 6,526,255 B2
DATED : February 25, 2003
INVENTOR(S) : K. Itoh et al.

It is certified that error appears in the above-identified patent and that said Letters Patent is hereby corrected as shown below:

Column 18,
Line 23, “an” should be -- a --.

Signed and Sealed this

Seventh Day of October, 2003

JAMES E. ROGAN
*Director of the United States Patent and Trademark Office*